US008622440B2

(12) United States Patent
Crichton et al.

(10) Patent No.: US 8,622,440 B2
(45) Date of Patent: Jan. 7, 2014

(54) KNOT TYING DEVICE AND CARTRIDGE SYSTEM FOR PROVIDING TYING FILAMENT THERETO

(75) Inventors: Peter John Crichton, Wheaton, IL (US); Monte Douglas Tweten, Stanwood, WA (US); Thomas Peterson, Algonquin, IL (US); James Davidson, St. Charles, IL (US); Alan Zantout, Sycamore, IL (US); Ganapathi Balasubrahmanyam, Mumbai (IN); John Desouza, Mumbai (IN); Paritosh Singh, Surat (IN); Alok Kulkarni, Navi-Mumbai (IN); Puneetkumar Birla, Pune (IN); Manish B. Patil, Virar (IN); Raveesha Shettigara, Karnataka (IN); Sachin Seth, Maharastra (IN); Vinodkumar Shrawan Shirsath, Maharastra (IN); Sampat Namdeo Dighe, Maharastra (IN); Vikas Mali, Mumbai (IN)

(73) Assignee: Ideal Industries, Inc., Sycamore, IL (US)

( * ) Notice: Subject to any disclaimer, the term of this patent is extended or adjusted under 35 U.S.C. 154(b) by 56 days.

(21) Appl. No.: 13/252,411

(22) Filed: Oct. 4, 2011

(65) Prior Publication Data

US 2012/0326442 A1 Dec. 27, 2012

Related U.S. Application Data

(60) Provisional application No. 61/389,963, filed on Oct. 5, 2010, provisional application No. 61/523,528, filed on Aug. 15, 2011.

(51) Int. Cl.
*B65H 69/04* (2006.01)

(52) U.S. Cl.
USPC ..... 289/1.5; 289/2; 289/17

(58) Field of Classification Search
USPC ..... 289/1.5, 2, 15, 17; 53/582, 589; 248/49, 248/68.1
See application file for complete search history.

(56) References Cited

U.S. PATENT DOCUMENTS 3,057,648 A * 10/1962 Schwarze et al. ..... 289/17
3,121,540 A 2/1964 Furst
3,391,440 A * 7/1968 Harms ..... 29/565

(Continued)

OTHER PUBLICATIONS

European Patent Office, Supplementary European Search Report issued on EP Patent Appln. No. 11831512.6 dated May 31, 2013, 4 pages.

(Continued)

*Primary Examiner* — Shaun R Hurley
(74) *Attorney, Agent, or Firm* — Greenberg Traurig, LLP

(57) ABSTRACT

A system includes a knot tying device for tying a filament in a knot around an article and a filament delivery device from which is drawn the filament. The filament delivery device may be in the form of a cartridge having a housing sized and arranged to be releasably attached to the knot tying device where the housing has an opening through which pre-cut or loosely coupled lengths of the filament can be drawn. The knot tying device includes a shuttle attachable to the filament where the shuttle is caused to be moved during a knot tying process around an article to be tied and a device for at least pulling the filament away from the article at appropriate times during the knot tying process.

47 Claims, 29 Drawing Sheets

(56) References Cited

U.S. PATENT DOCUMENTS

| | | | | | |
|---|---|---|---|---|---|
| 3,670,783 | A | | 6/1972 | Goodwill | |
| 4,094,342 | A | * | 6/1978 | Nishikawa et al. | 140/93.2 |
| 4,502,905 | A | * | 3/1985 | Jung et al. | 156/184 |
| 4,534,817 | A | * | 8/1985 | O'Sullivan | 156/352 |
| 4,558,894 | A | * | 12/1985 | Detterbeck et al. | 289/1.5 |
| 5,505,504 | A | | 4/1996 | Sato et al. | |
| 5,509,994 | A | * | 4/1996 | Recchia et al. | 156/468 |
| 5,573,627 | A | * | 11/1996 | Vuong | 156/392 |
| 5,716,368 | A | * | 2/1998 | de la Torre et al. | 606/148 |
| 6,136,118 | A | * | 10/2000 | Bartholomew et al. | 156/73.1 |
| 6,279,970 | B1 | | 8/2001 | Torres | |
| 6,354,336 | B1 | * | 3/2002 | Leban | 140/93.2 |
| 6,382,288 | B1 | * | 5/2002 | Park et al. | 156/468 |
| 6,457,492 | B1 | * | 10/2002 | Kuhn et al. | 140/123.6 |
| 6,513,555 | B1 | * | 2/2003 | Lesser et al. | 140/123.6 |
| 6,641,181 | B2 | | 11/2003 | Thomas et al. | |
| 6,648,378 | B1 | | 11/2003 | Torres et al. | |
| 8,146,491 | B2 | * | 4/2012 | Schaety et al. | 100/27 |
| 8,334,045 | B2 | * | 12/2012 | Schaety et al. | 428/167 |
| 2007/0088390 | A1 | * | 4/2007 | Paz et al. | 606/232 |
| 2010/0038906 | A1 | | 2/2010 | Herren | |

OTHER PUBLICATIONS

European Patent Office, Supplementary European Search Report issued on EP Patent Appln. No. 13160249.2 dated May 31, 2013, 5 pages.

* cited by examiner

KNOT TYING DEVICE AND CARTRIDGE SYSTEM FOR PROVIDING TYING FILAMENT THERETO

RELATED APPLICATION DATA

This application claims the benefit of U.S. Provisional Application No. 61/389,963, filed on Oct. 5, 2010, and U.S. Provisional Application No. 61/523,528, filed on Aug. 15, 2011, the disclosures of which are incorporated herein by reference in their entirety.

BACKGROUND

In the art, devices that generally function to provide a wire about an article are known.

By way of example, U.S. Pat. No. 5,505,504 describes an apparatus that includes a mechanism for forming a U-shaped loop of a tying wire, a mechanism for guiding the U-shaped loop to wind it around an external surface of a portion of an article to be tied, a mechanism for twisting the closed end and the other end of the U-shaped loop, and a mechanism for cutting the tying wire at an appropriate time to an appropriate length.

By way of further example, U.S. Pat. No. 6,279,970 describes an automatic knot-tying device for tying a discrete knot about an article, such as a bundle of wires. The device functions by pulling a filament transversely around the article and includes a hand-held housing and a knot-tying mechanism within that housing comprised of a hollow nozzle for leading the filament toward the article, a wrapping ring for wrapping the filament around the article, and a plurality of pins that extend into and retract out of the path of the filament to form the knot. The operation is finished by cinching and cutting the loose filament so that the resulting knot is discrete and secure.

U.S. Pat. No. 6,648,378 also describes an automatic knot-tying device for tying a discrete knot about an article, such as a bundle of wires. The device works by pulling a filament, such as the FAA-approved lace, transversely around the article. The device includes a hand-held housing and a knot-tying mechanism within that housing comprised of a plurality of carriage rings, for wrapping the filament around the article, at least one shuttle for moving the filament between the carriage rings and along the article at the appropriate steps, and a plurality of hooks for pulling the filament away from the article at the appropriate steps. The operation is finished by cinching, cutting, and reloading so that the resulting knot is discrete and secure.

While the devices described in these publications, which are incorporated herein by reference in their entirety, generally work for their intended purpose, the following describes an improved knot tying device and cartridge system for providing tying filament thereto.

SUMMARY

Described hereinafter is an improved knot tying device and a cartridge system for providing tying filament thereto, such as, by way of example only and without limitation, a multi-stranded lace, a single-stranded lace, an FAA-approved lace, etc.

For example, the knot tying device may include a pair of rings (which are preferably separable) that surround the article where each of the pair of rings has a continuous channel formed therein with the channels of each of the pair of rings being located opposed to one another, a shuttle attachable to the filament (which assembly may include a filament feeding mechanism as well as a gripping mechanism) where the shuttle is caused to be moved during a knot tying process between and within the channels of each of the pair of rings and thereby around and along a length of the article, for example by use of selectively activated electromagnets, and at least one hook for pulling the filament away from the article at appropriate times during the knot tying process.

The knot-tying mechanism may alternatively include a shuttle adapted to releasably grasp the filament, wherein the shuttle moves in a circular path on a single knot forming plane and a device for pulling the filament away from the article at appropriate times during a knot tying process and for rotating the filament to thereby form loops through which the shuttle carrying the filament is passed.

The cartridge preferably has a housing that is sized and arranged to be releasably attached to the knot tying device. The housing has an opening through which pre-cut or loosely coupled lengths of the filament can be drawn.

While the foregoing provides a general description of the subject device and system, a better understanding of the objects, advantages, features, properties and relationships of the subject device and system will be obtained from the following detailed description and accompanying drawings which set forth illustrative embodiments and which are indicative of the various ways in which the principles of the invention may be employed.

BRIEF DESCRIPTION OF THE DRAWINGS

For a better understanding of the hereinafter described knot tying device and cartridge system for providing tying filament thereto, reference may be had to the following drawings in which.

DETAILED DESCRIPTION

In many industries, both military and commercial, such as the aircraft, automotive, and appliance industries, wire bundles, or harnesses, are used extensively in the manufacturing processes of various products. Each bundle, or harness, generally comprises two or more wires that are customarily tied together at various points along their lengths to help ensure safety and durability, as well as a generally clean design. The subject knot tying device and cartridge system for providing tying filament thereto, particularly FAA and/or military approved lace, function to allow an operator to tie required knots around such articles.

Figure 1:
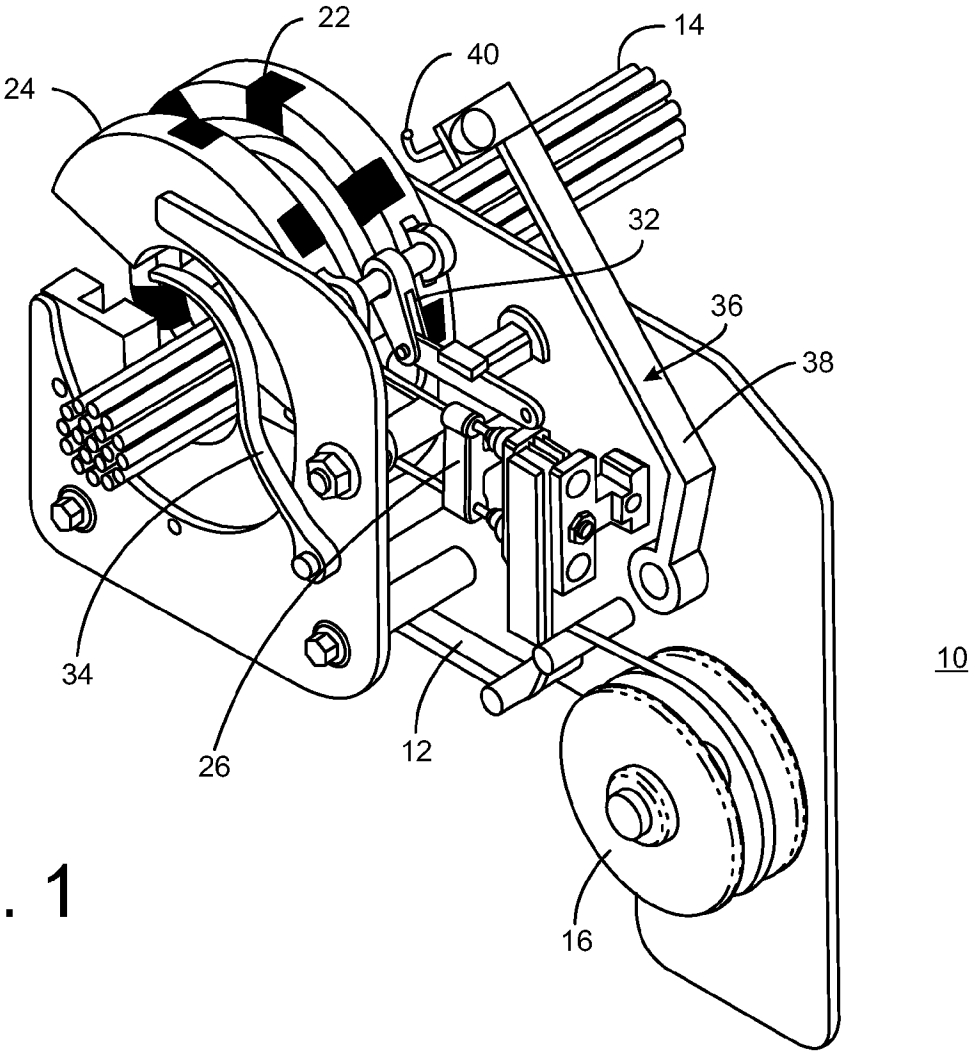
FIG. 1 is a perspective view of an exemplary knot tying device constructed according to the description that follows.
Figure 2:
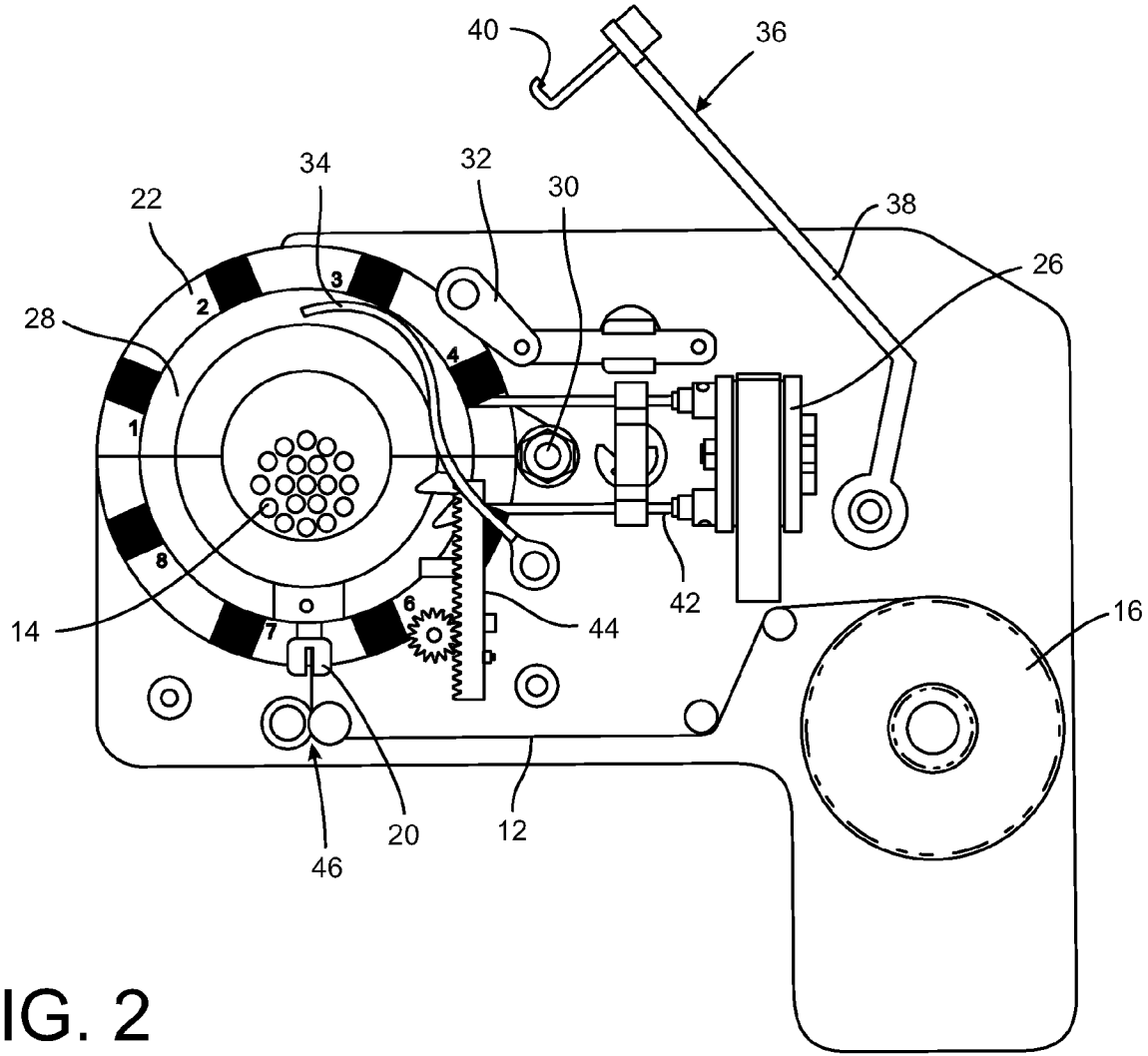
FIG. 2 is a sectional view of the knot tying device illustrated in FIG. 1.
Figure 3:
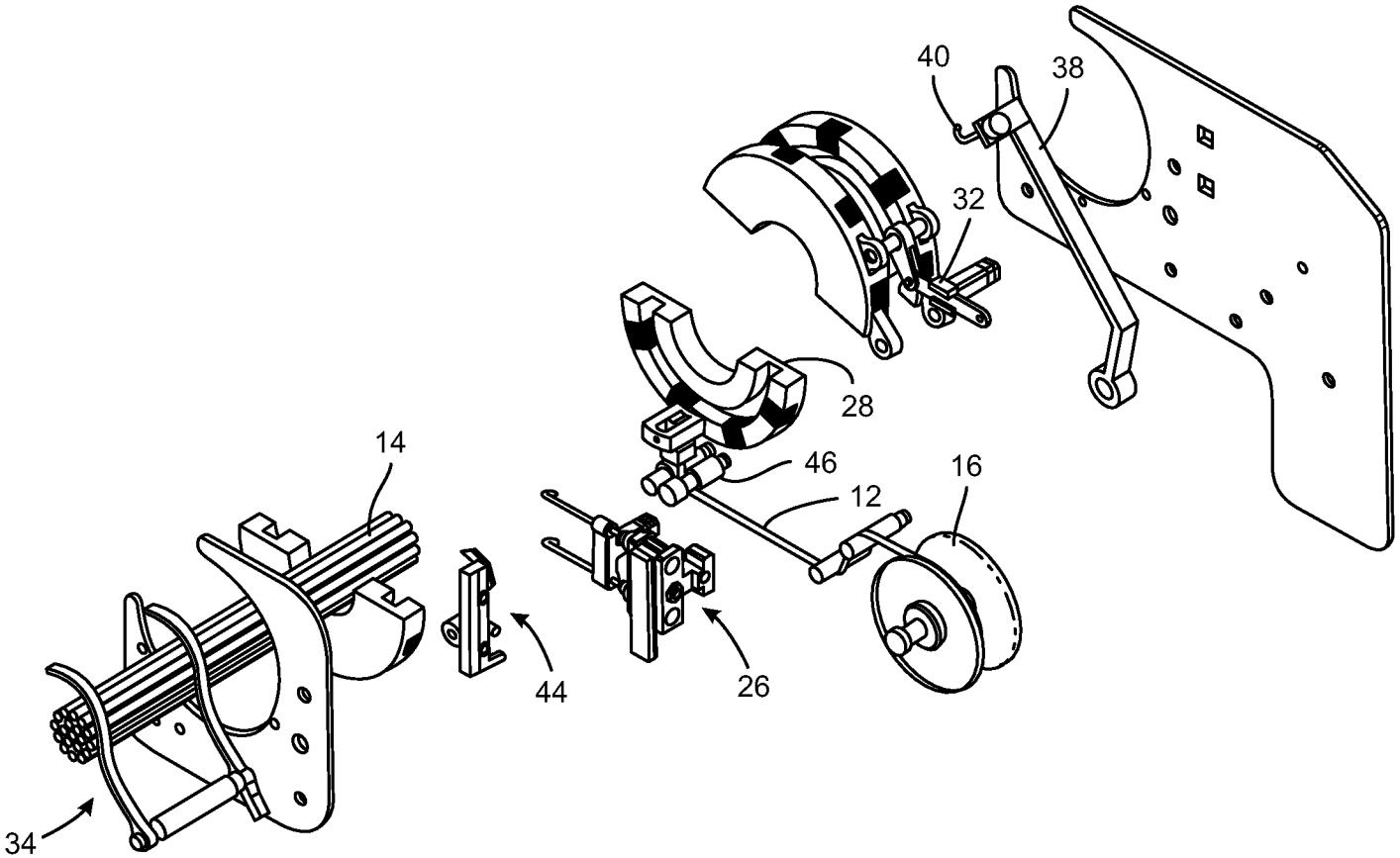
FIG. 3 is an exploded view of the knot tying device illustrated in FIG. 1.
Figure 5:
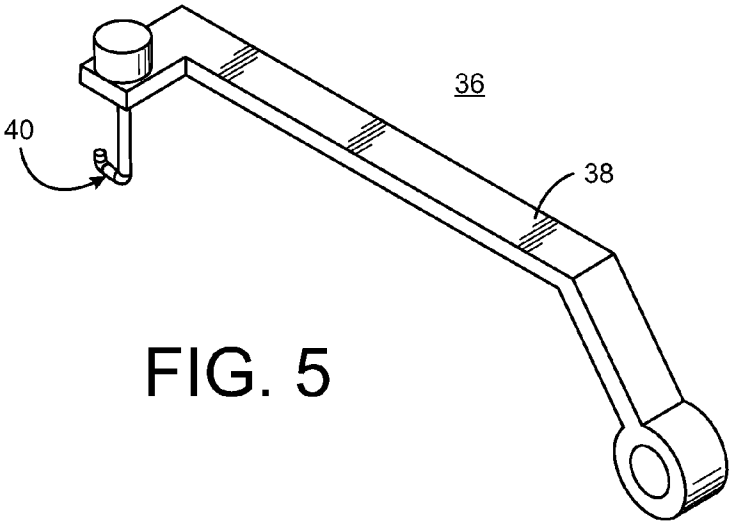
FIG. 5 is a perspective view of an exemplary tensioning assembly of the knot tying device illustrated in FIG. 1.
Figure 6B:
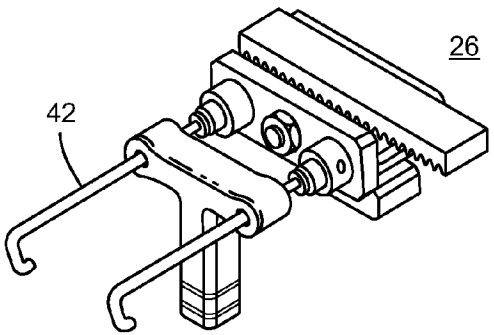
FIGS. 6A and 6B are perspective views of an exemplary looping hook assembly of the knot tying device illustrated in FIG. 1.
Figure 4:
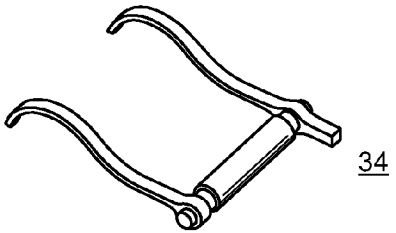
FIG. 4 is a perspective view of an exemplary cable clamp assembly of the knot tying device illustrated in FIG. 1.
Figure 6A:
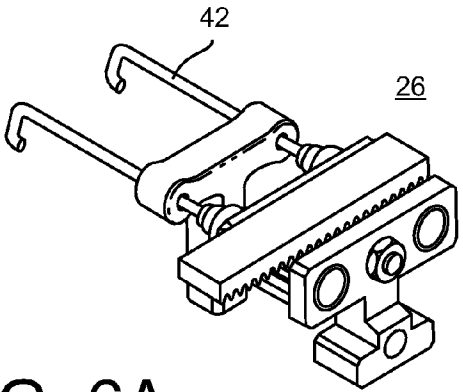
Figure 8:
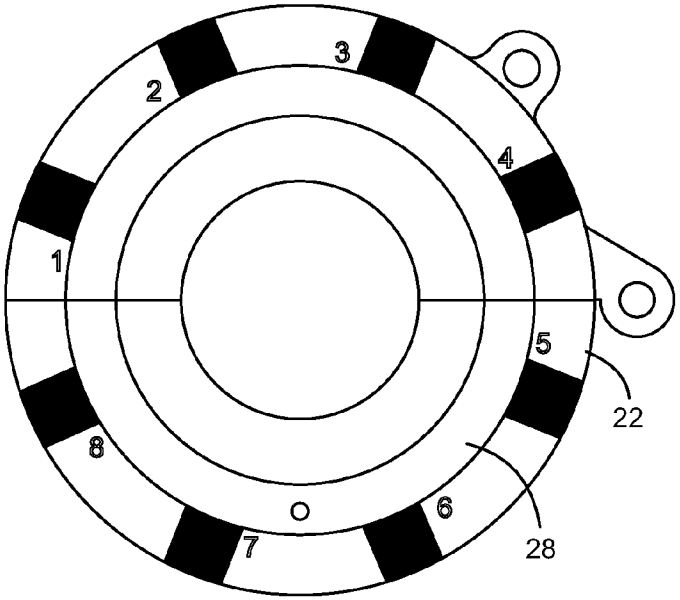
FIG. 8 is a side view of a complete, exemplary ring assembly of the knot tying device illustrated in FIG. 1.
Figure 7:
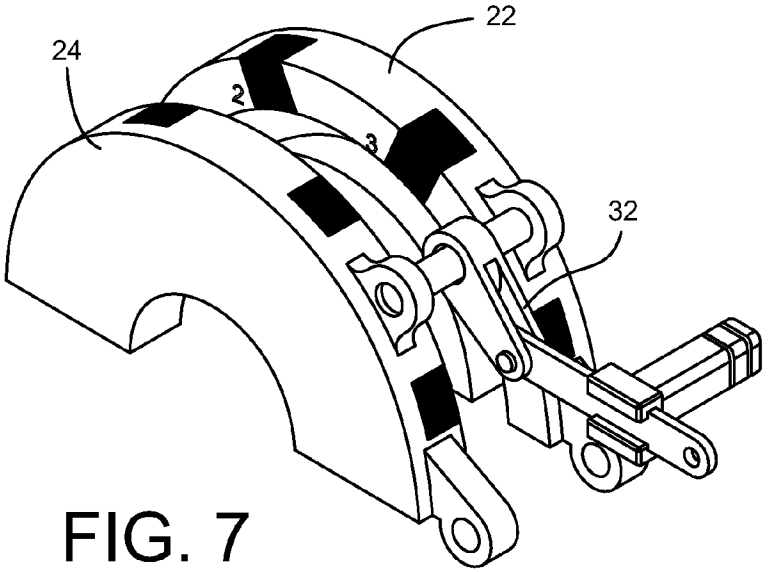
FIG. 7 is a perspective view of a top half portion of an exemplary ring assembly of the knot tying device illustrated in FIG. 1.
Figure 9:
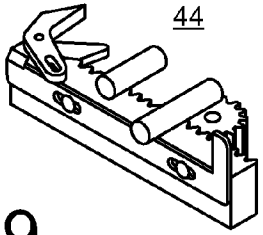
FIG. 9 is a perspective view of an exemplary trimming mechanism of the knot tying device illustrated in FIG. 1.
Figure 10:
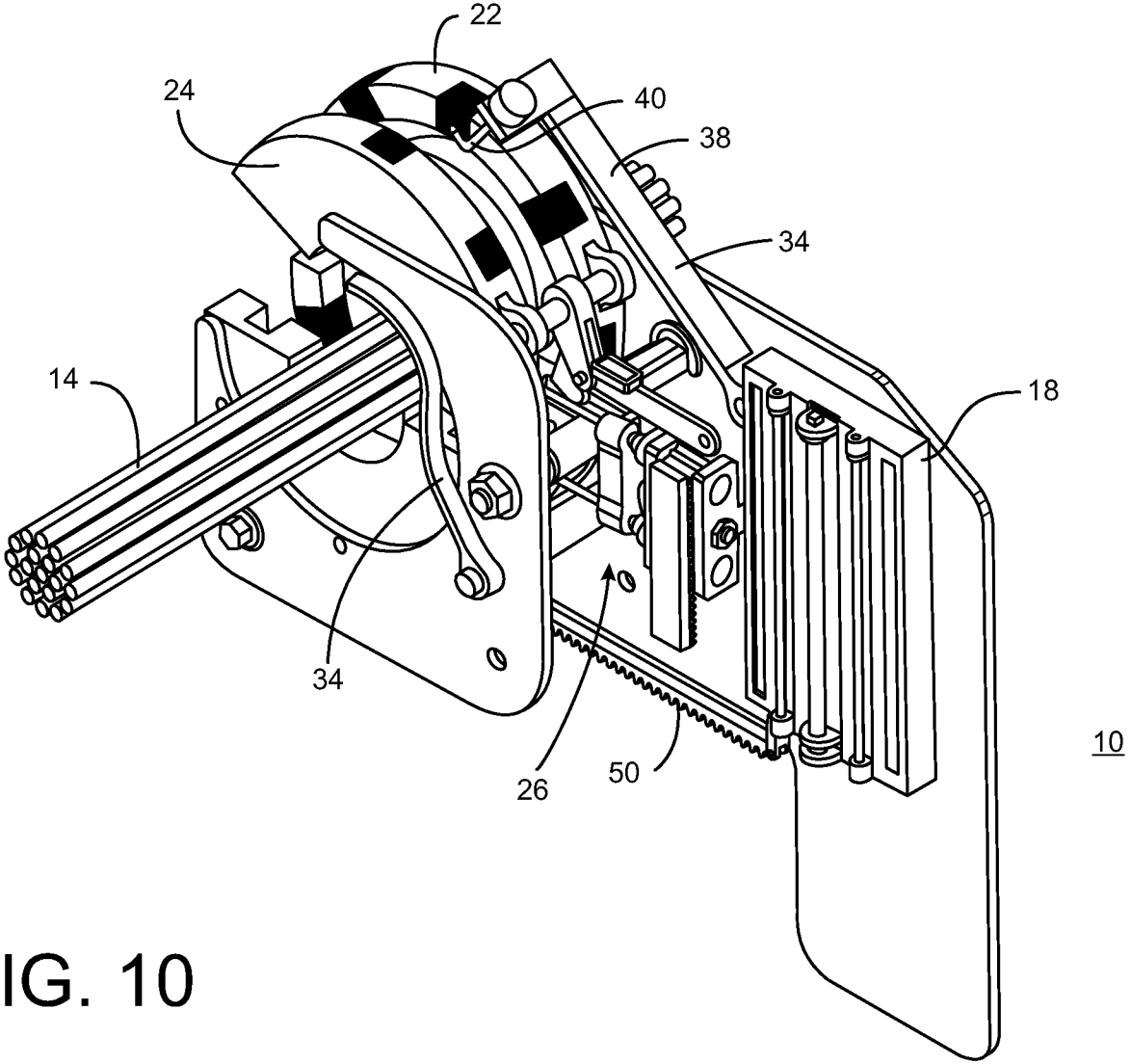
FIG. 10 is a perspective view of the knot tying device of FIG. 1 with an exemplary cartridge system for providing tying filament thereto.

Turning now to the Figures, illustrated in FIGS. 1-13 is an exemplary knot tying device 10. Preferably, the knot tying device 10 is incorporated into a housing (not illustrated for the sake of clarity) and is sized and configured to allow the device to be hand carried and operated. As will become apparent, the knot tying device 10 is usable to tie a filament 12 about an article 14 to be tied, such as a wire bundle. The filament 12 is supplied to the knot tying device 10 from a user replaceable spool 16 which is mountable to the device, as illustrated in FIG. 1, or, in a further embodiment, the filament 12 can be supplied to the knot tying device 10 from a user replaceable cartridge 18 which is also mountable to the device, as illustrated in FIG. 10 and described in greater detail hereinafter.

For tying a knot around the article 14, the knot tying device 10 includes a filament carrying shuttle assembly 20 (to which is fed filament 12 from the filament delivery device 16/18 that is being utilized), a pair of oppositely facing, i.e., left and right, ring assemblies 22 and 24 between which the shuttle assembly 20 is moved while carrying the filament 12, and a looping hook assembly 26 which functions to pull the filament 12 during operation away from the article 14 to thereby provide openings through which the shuttle assembly 20 will pass to thereby create knots—such as illustrated by way of example only in FIG. 14A-14L. The shuttle assembly may itself include a feeding mechanism to assist in moving the filament 12 to a gripping mechanism which is used by the shuttle assembly to carry the filament 12.

For moving the shuttle assembly 20 around the exterior surface of the article 14 and between the ring assemblies 22 and 24, i.e., across the article 14, and, more particularly, to move the shuttle assembly 20 between and within channels 28 that are formed in the ring assemblies 22 and 24 (which channels 28 preferably have a depth such that, when the shuttle assembly 20 is within a channel of one of the ring assemblies 22 and 24, the shuttle assembly 20 will be clear of the channel of the other of the ring assemblies 22 and 24—which channel depth may be at least sufficient to ensure that the shuttle will not be allowed to fall out of the channel), each of the ring assemblies 22 and 24 is provided with an associated plurality of electromagnet coils which, when selectively activated, function to attract (or repel) and thereby direct the movement of the shuttle assembly 20 as desired to perform the knot tying steps. The electromagnetic coils may be embedded within the channels of the ring assemblies 22 and 24, may be positioned adjacent to an exterior, backside surface of the ring assemblies 22 and 24, or the like without limitation. As will be appreciated, the shuttle assembly 20 is thus preferably constructed with a ferrous material (possibly even with a magnetic material) to allow the shuttle assembly 20 to be drawn to (or repelled from) one or more of the plurality of electromagnetic coils that is currently being activated. While not required, the ring assemblies 22 and 24 are preferably constructed from a non-ferrous material. In any event, the ring assemblies 22 and 24 are preferably constructed from a durable material that will present minimal friction as the shuttle assembly 20 is being drawn between and within the channels 28 of the ring assemblies 22 and 24. As will further be appreciated, the knot tying device 10 will include a processor and associated instructions for selectively activating the plurality of electromagnetic coils in a given sequence to thereby cause the shuttle assembly 20 to be moved around the article 14 as desired to form a given knot. The processor and associated instructions may also be used to control other mechanisms, such as motors, actuators, solenoids, etc, of the knot tying device 14 as will be readily appreciated. Accordingly, the knot tying device 10 may be provided with electrical power, such as from a battery, wall outlet, etc., to provide power to the processor, any motors, actuators, solenoids, etc. In certain circumstances, it will also be appreciated that other power sources, such as pneumatic power, could be used to drive any moveable/driven parts described herein.

Figure 16:
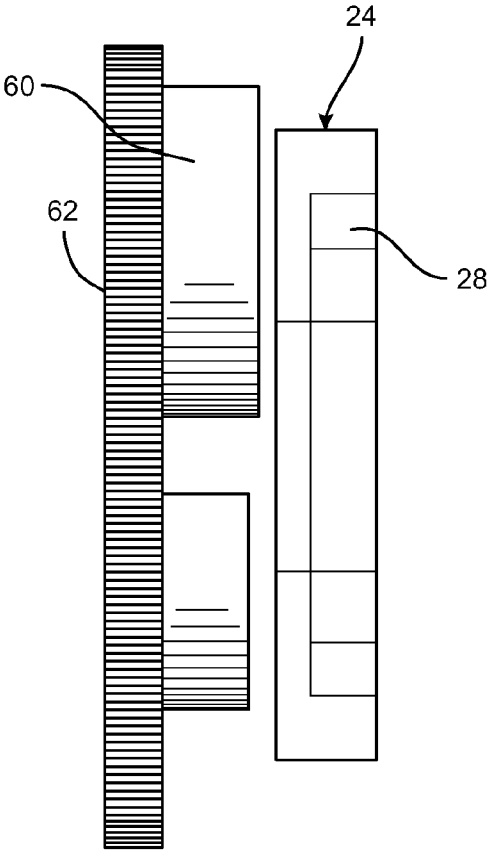
FIG. 16 illustrates a side view of the exemplary system for moving an electromagnetic illustrated in FIG. 15.
Figure 15:
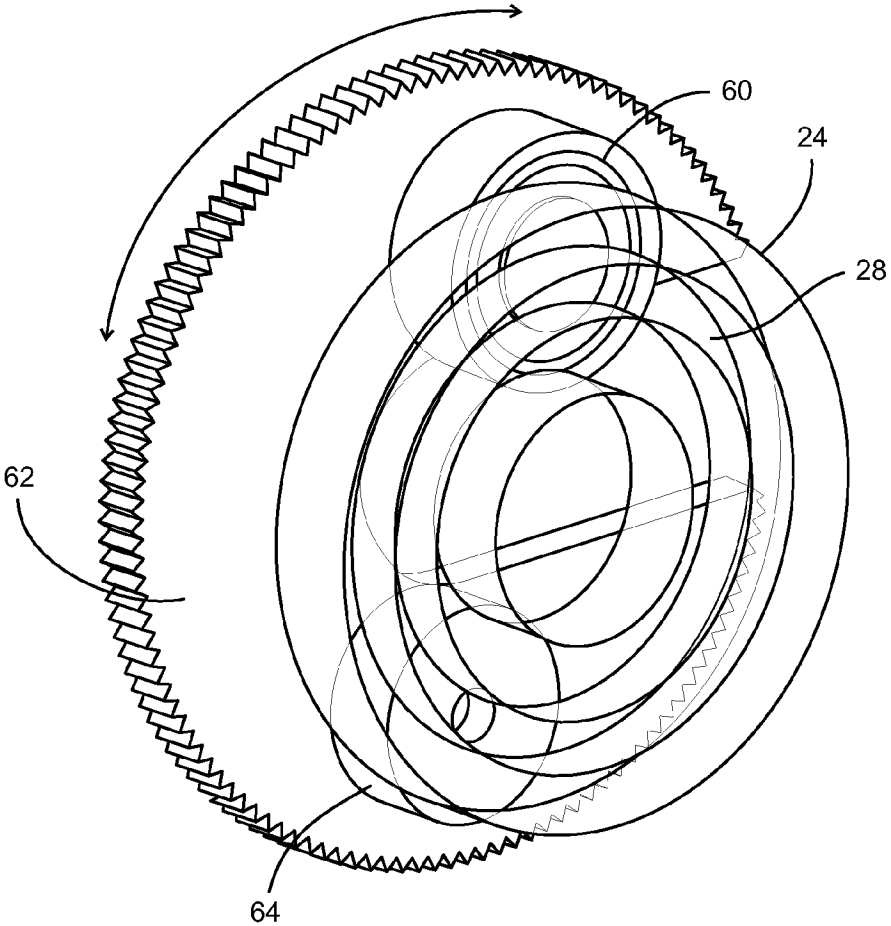
FIG. 15 illustrates a see-through perspective view of an exemplary system for moving an electromagnetic used to control movement of a shuttle assembly.

In a yet further embodiment, for moving the shuttle assembly 20 around the exterior surface of the article 14 and between the ring assemblies 22 and 24, one or more electromagnets 60 (which would be selectively activatable as needed to move the shuttle assembly) may be mounted on a further driven plate 62, such as a gear, that is positioned adjacent to the exterior backside of each of the ring assemblies 22 and 24. As will be appreciated, the driven plate 62, an example of which is shown in FIGS. 15 and 16, may be controlled to rotate about the article 14 to thereby cause the electromagnet (s) 60 to rotate about the article 14 which electromagnet(s) 60, when selectively activated, will cause the shuttle assembly to be moved within and between the stationary ring assemblies 22 and 24. In addition, to allow for the feeding of the article into the device, the driven plate 62 may include an opening such as illustrated in FIG. 15, which may be separable in the manner of the ring assemblies, or the like without limitation. Yet further, the driven plate 62 may carry one or more counter weights 64 as necessary to balance the driven plate 62 during rotation thereof.

For allowing the article 14 to be placed into the knot tying device 10, the ring assemblies 22 and 24 may be made so as to be separable. By way of example only, the ring assemblies 22 and 24 may comprise a lower half and an upper half wherein the upper half is moveable relative to the lower half to thereby create a space in which the article 14 may be inserted. To this end, the back ends of the upper half of the ring assemblies 22 and 24 may be pivotally connected 30 to the device housing (with, in this example, the lower half of the ring assemblies 22 and 24 being fixed to the device housing) with a motor or the like driven linkage 32—which may be trigger operated—being further coupled the upper half of the ring assemblies 22 and 24 where the driven linkage 32 is moveable to cause the upper half of the ring assemblies 22 and 24 to be opened and closed relative to the lower half of the ring assemblies 22 and 24. While this describes one manner for opening and closing the ring assemblies, i.e., to create a separation between the ring assembly halves, it will be appreciated that alternatives may be utilized, such as causing the lower half of the ring assemblies 22 and 24 to be moveable with the upper half of the ring assemblies 22 and 24 being fixed, by causing both halves of the ring assemblies 22 and 24 to be moveable, and the like. Once the article 14 has been placed within the knot tying device 10, e.g., the ring assemblies 22 and 24 have been opened to create a space into which the article 14 is positioned, a driven clamping assembly 34 can be lowered onto the article 14 to thereby clamp the article into position within the ring assemblies 22 and 24.

For tensioning the filament 12 during the knot tying process, a driven tensioning mechanism 36 is provided. In the illustrative example, the tensioning mechanism 36 comprises an arm 38 that is pivotally attached to the housing and a hook 40 that is rotatably attached to the arm 38. During the knot tying operation, the arm 38 of the tensioning mechanism 36 may be driven so as to be lowered into an area between the ring assemblies 22 and 24 whereupon the hook 40 can be driven so as to rotate and hook around the filament 12 as the filament 12 spans between the ring assemblies 22 and 24. Alternatively, the tensioning mechanism 36 may be driven so as to be lowered into an area between the ring assemblies 22 and 24 and the hook driven to rotate with the filament 12 being then passed over the hook. After the filament 12 is hooked in either of these manners, the arm 38 can be driven so as to be raised to thereby provide tension to the filament 12. As the knot tying operation proceeds, a spring, induced motor torque, or the like associated with the tensioning mechanism 36 will function to maintain the tension on the filament 12. After the knot tying operation is completed, the arm 38 can be driven back into the area between the ring assemblies 22 and 24 (if necessary) and the hook 40 driven to rotate to thereby release or unhook the filament 12 from the tensioning mechanism 36.

It will also be appreciated that the tensioning mechanism can be moved tangentially to the ring assemblies 22 and 24 to provide tension to the filament 12. In preferred embodiments, the tension the device applies to the filament used to bundle the wires can be user definable.

Like the tensioning mechanism, the looping hook assembly 26 comprises at least one hook 42 that is to be driven into and out of the area between the ring assemblies 22 and 24 to hook and release/unhook the filament 12 as necessary to create space in which the shuttle assembly 20, while carrying filament 12, may pass to thereby create the desired knot. In addition, the looping hook assembly 26 may be desired to be tangentially moveable with respect to the ring assemblies 22 and 24. For this purpose, the hook 42 may be mounted to a driven rack and pinion assembly as particularly shown in FIGS. 6A and 6B. The hook 42 may also be driven to rotate to further provide for the hooking of and releasing/unhooking of the filament 12.

For cutting the filament 12 after a knot has been tied around the article 14 by the knot tying device 10, a trimming mechanism 44 is provided. By way of example only, the trimming mechanism 44 comprises a fixed blade and a moveable blade between which the filament 12 is positioned. To thereby cut the filament 12, the moveable blade is driven to be moved relative to the fixed blade whereupon the two blades will close upon the filament 12. In the exemplary trimming mechanism illustrated in FIG. 9, the moveable blade is driven to be moved through use of a rack and pinion assembly. As will be appreciated, other assemblies/mechanisms for moving the moveable blade and/or trimming the filament 12 could be employed without limitation.

For feeding the filament 12 to the shuttle assembly 20 whereupon a mechanism associated with the shuttle assembly will function to grasp the filament 12, a feed assembly 46 is provided. In an exemplary embodiment, the feed assembly 46 comprises a pair of driven rollers. It will be appreciated that other mechanisms capable of performing this function could also be employed.

Figure 11:
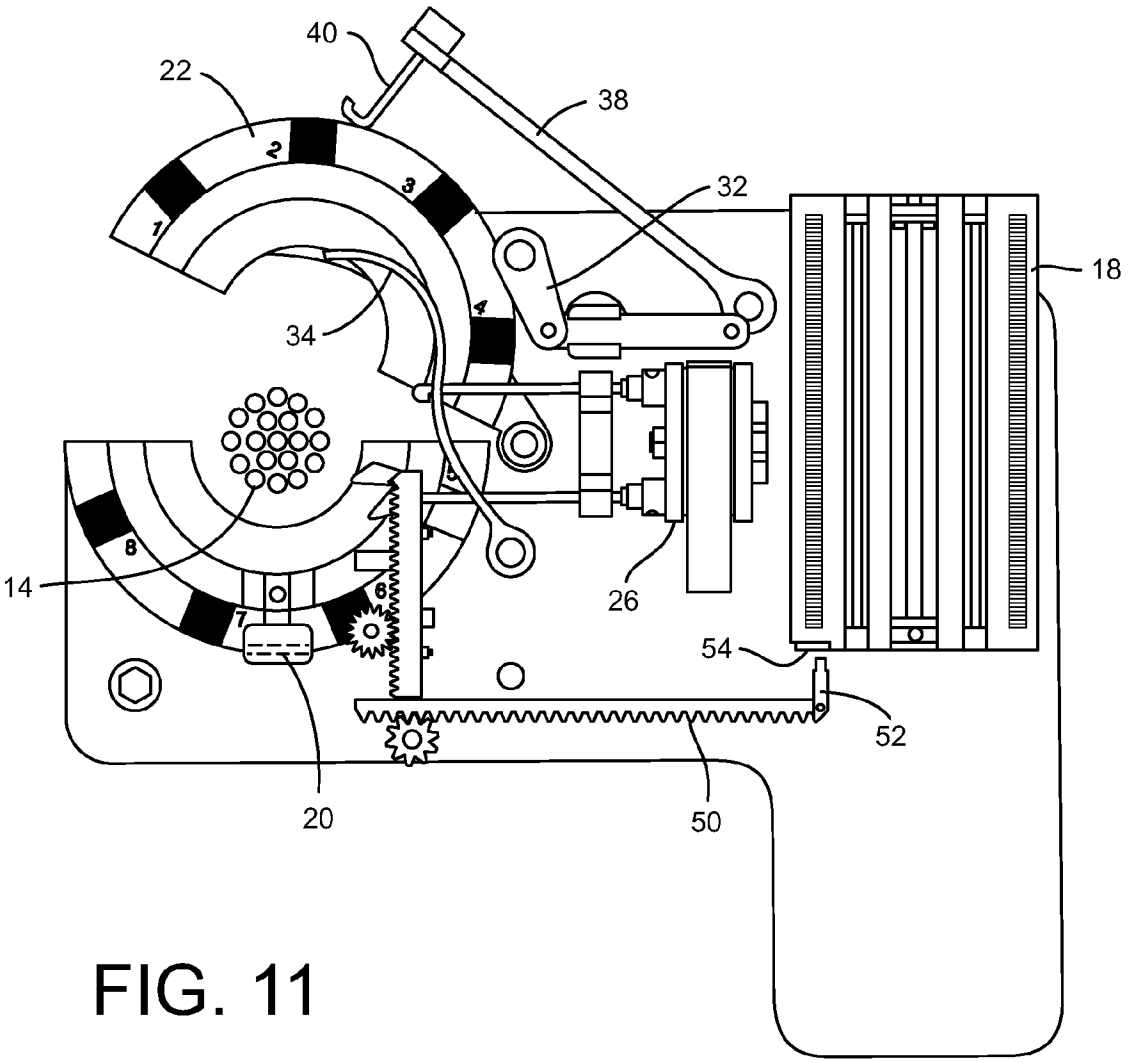
FIG. 11 is a sectional view of the knot tying device illustrated in FIG. 10.
Figure 12:
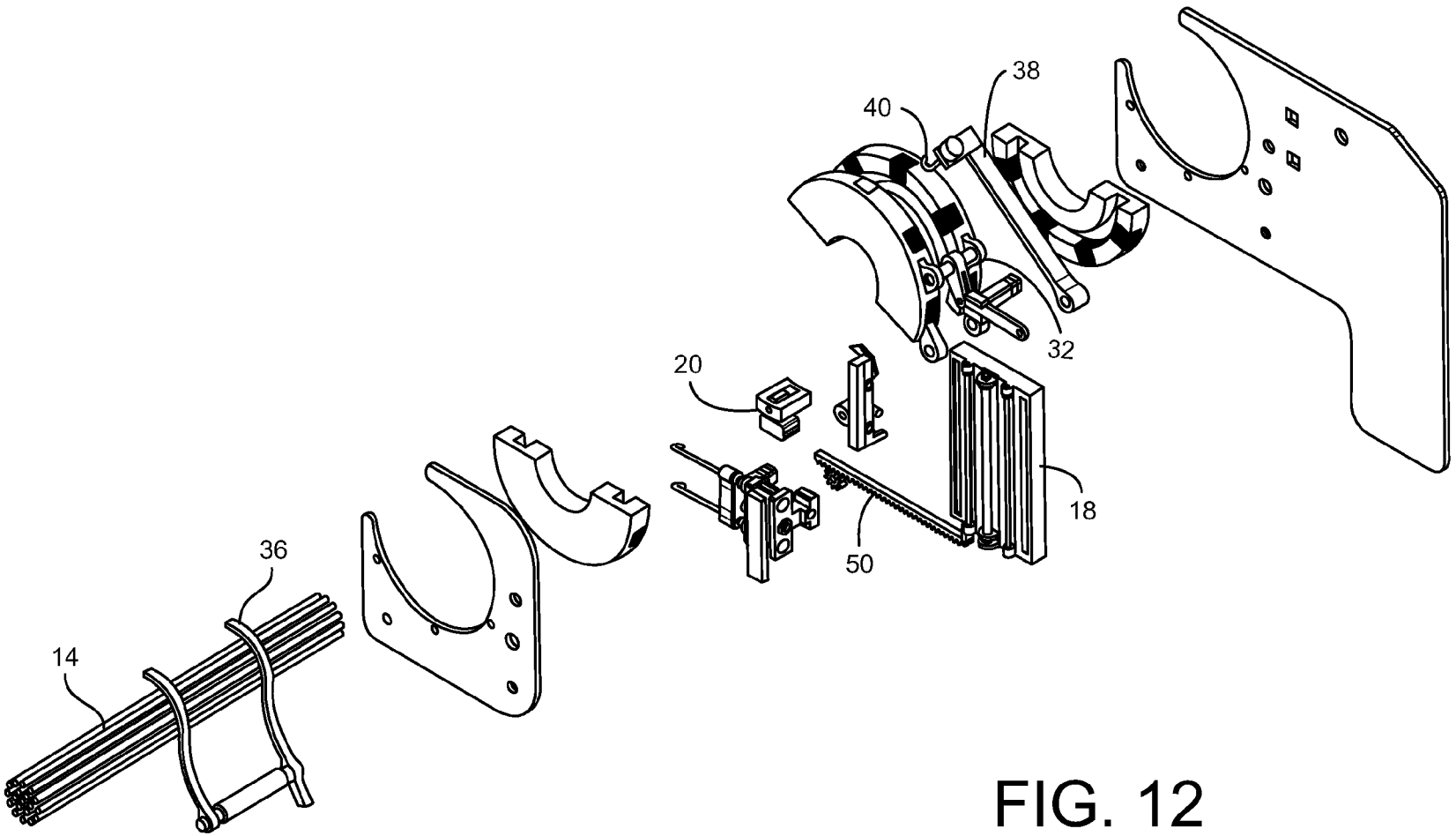
FIG. 12 is an exploded view of the knot tying device illustrated in FIG. 10.
Figure 13:
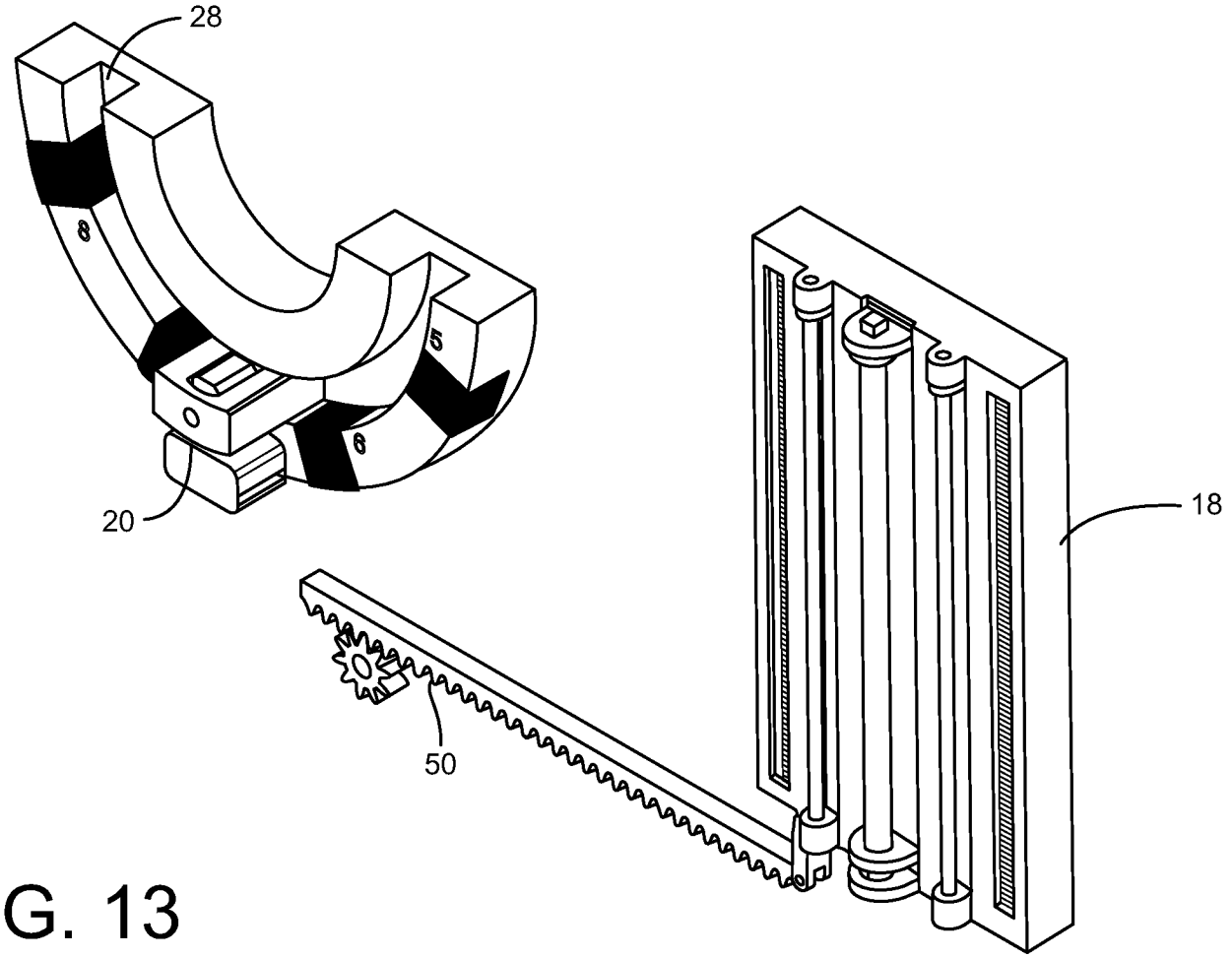
FIG. 13 is a perspective view of the cartridge illustrated in FIG. 10.
Figure 14B:
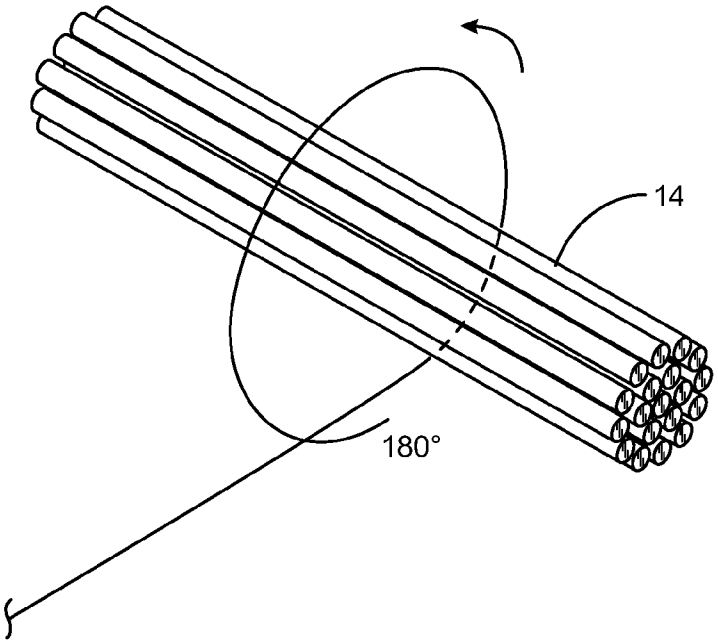
FIGS. 14A-14N illustrate movement steps of a tying filament by the exemplary knot tying device in forming an exemplary knot.
Figure 14A:
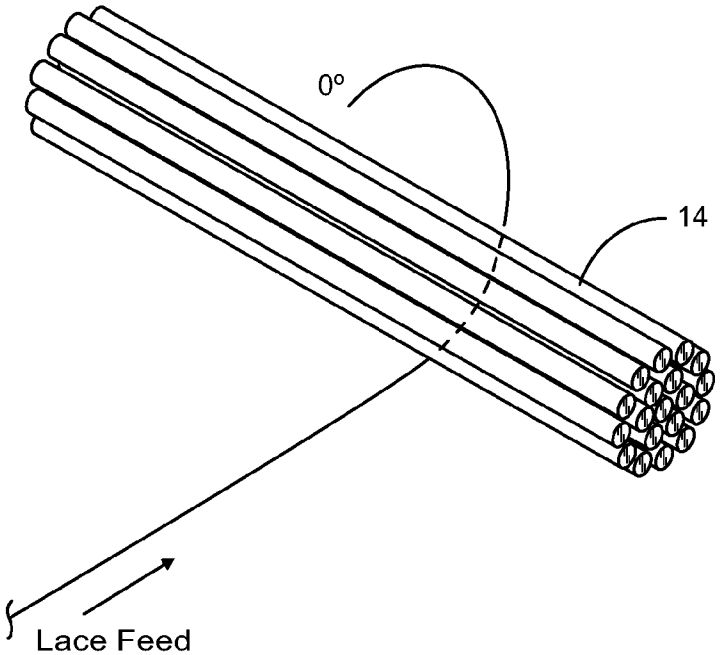
Figure 14D:
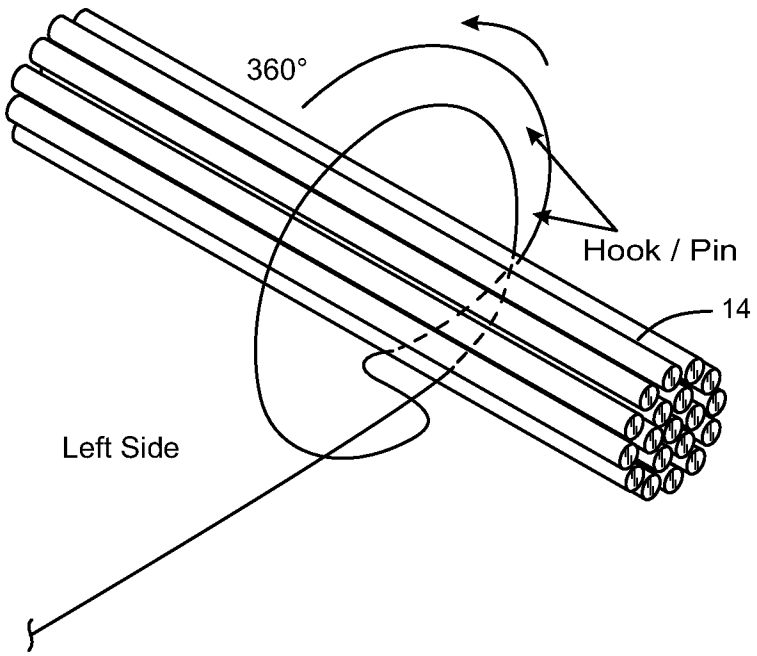
Figure 14C:
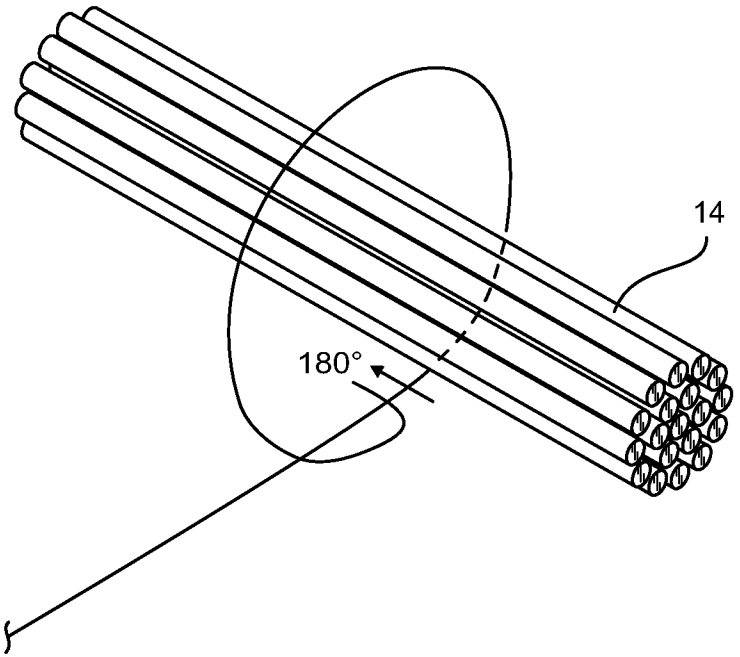
Figure 14F:
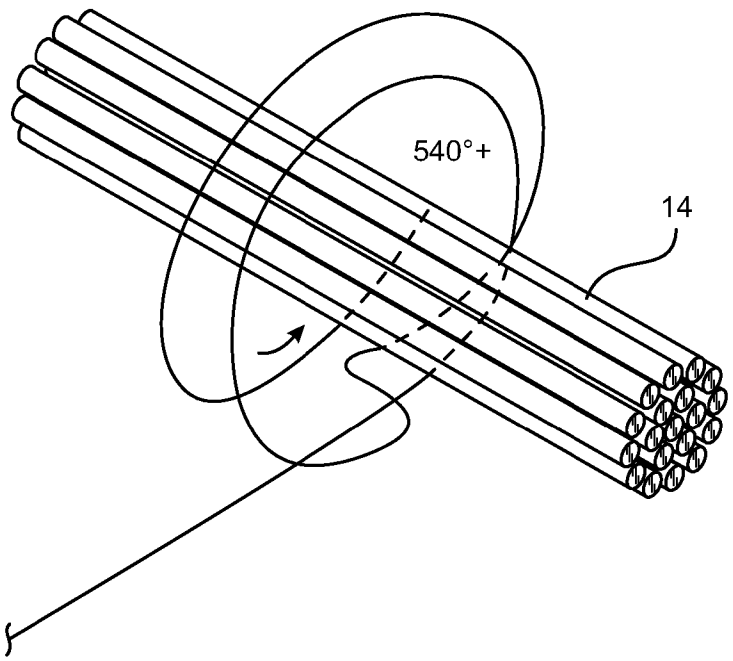
Figure 14E:
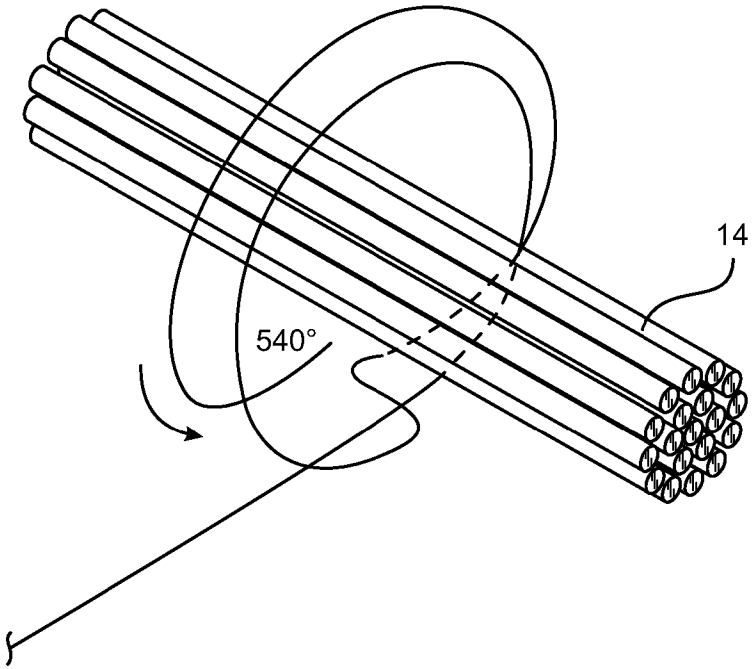
Figure 14H:
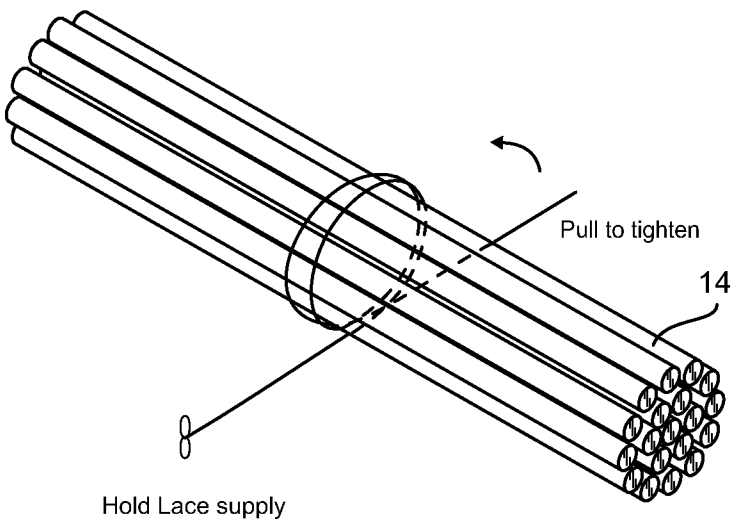
Figure 14G:
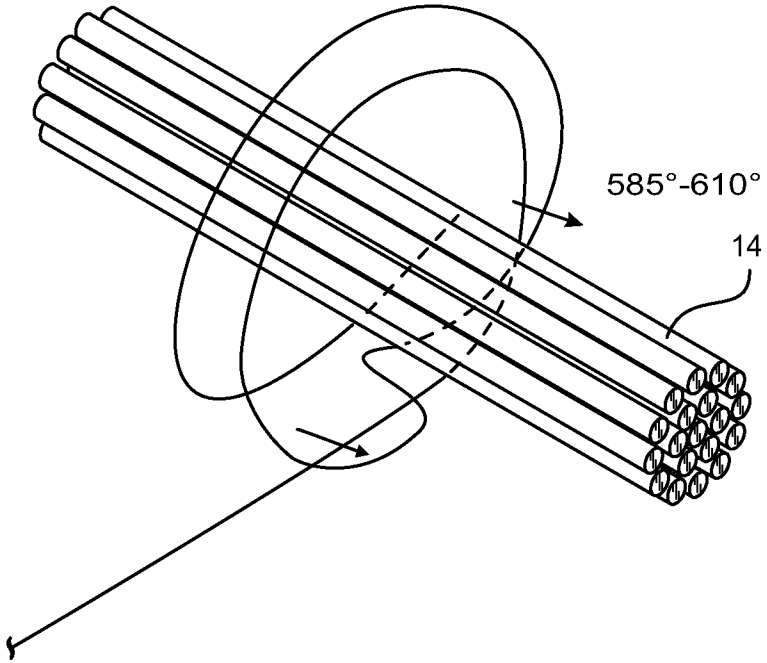
Figure 14J:
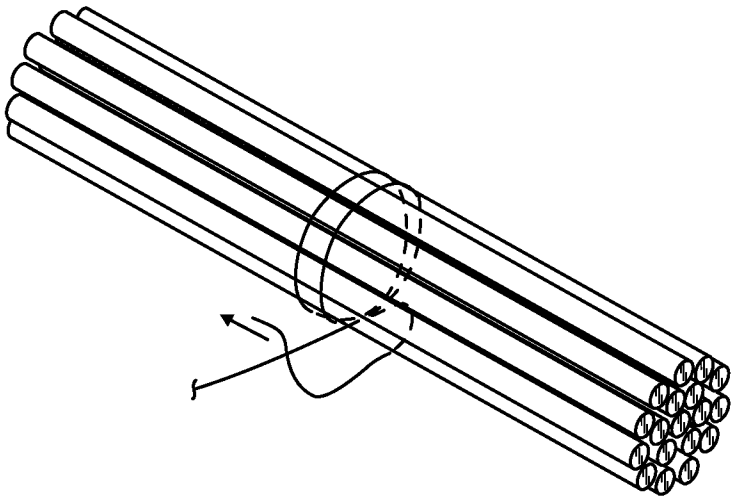
Figure 14I:
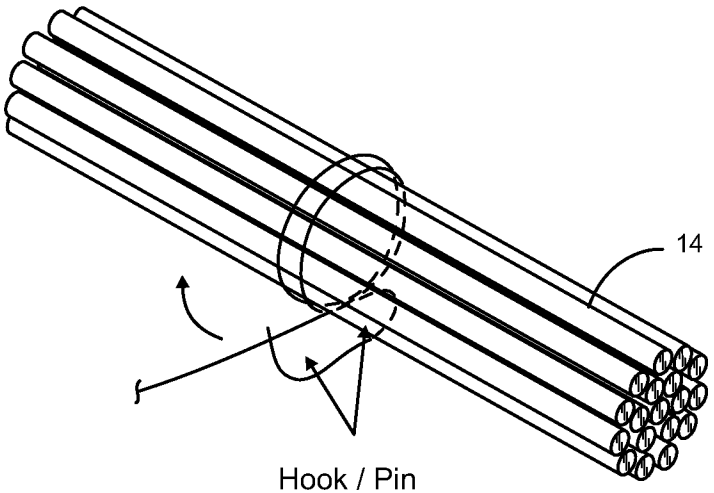
Figure 14L:
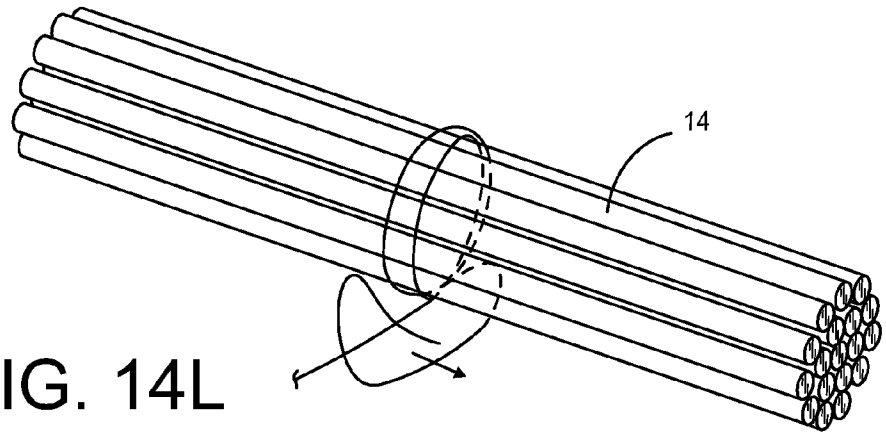
Figure 14K:
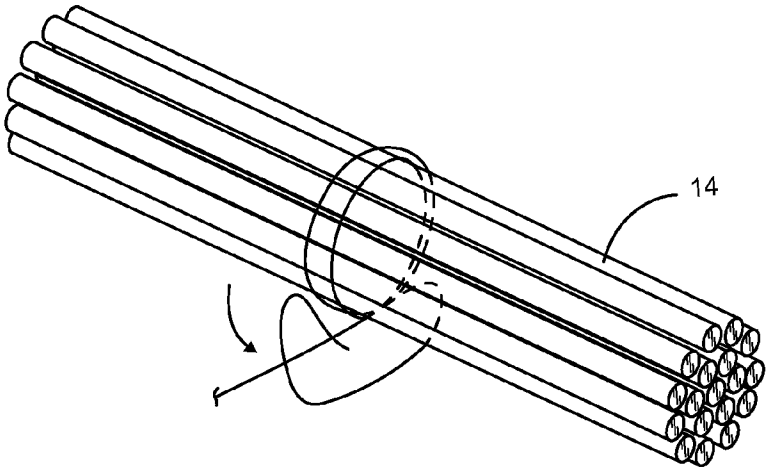
Figure 14N:
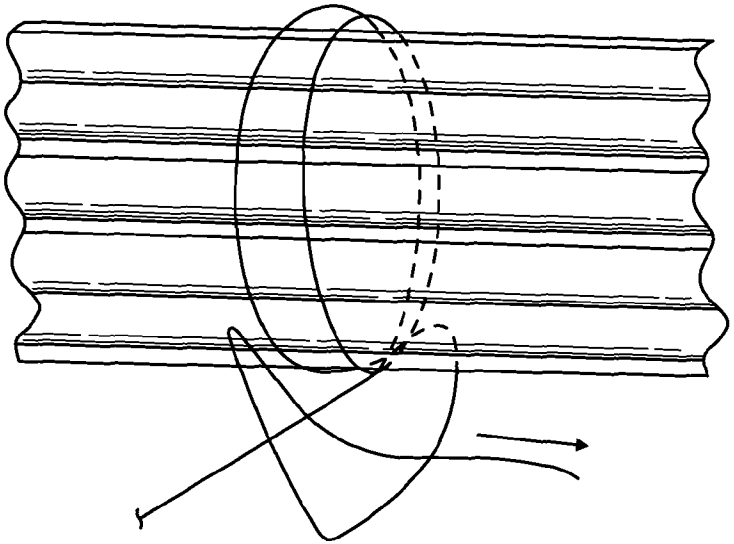
Figure 14M:
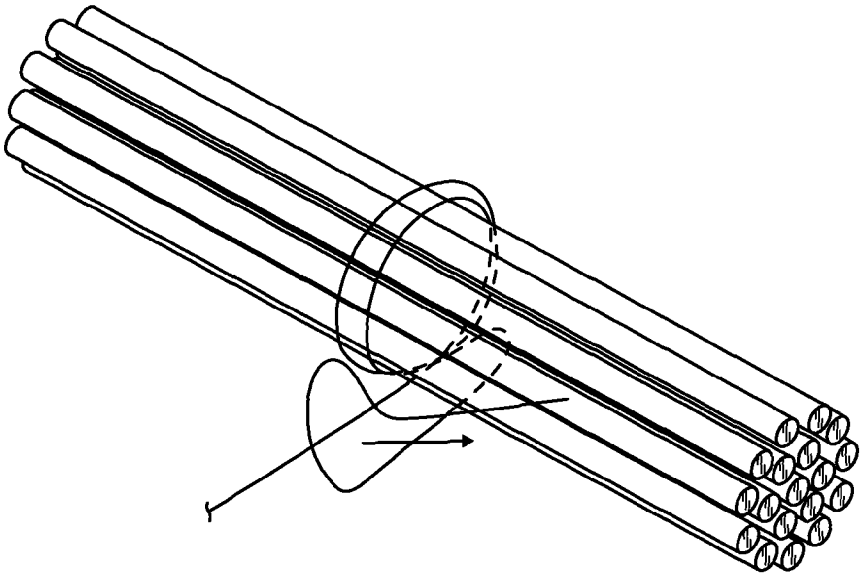

As noted above, in a further embodiment of the knot tying device 10, a cartridge 18, comprising an enclosed housing and an opening through which filament is to be drawn, can be used as the supply of tying filament. In this regard, the cartridge 18 can be removeably insertable into the knot tying device 10, for example by being snap-fit, slid-fit, post-mounted, or the like to the device housing, and can, as desired, include predetermined lengths of filament 12. In one embodiment, the pre-determined lengths of filament can be loosely coupled together such that, once the first filament length is drawn into the knot tying device 10 and used to tie a knot, additional filament lengths will be continually drawn into the knot tying device 10, i.e., they will follow a previously drawn filament length, until the supply of knot tying filament lengths is exhausted. Such loose coupling of the ends of filament lengths can be accomplished through the use of adhesives, scoring of an overall length of filament, providing a perforated leader between filament lengths, or the like without limitation. In such an embodiment, the filament lengths can be placed within the cartridge in a fanned or stacked relation, such as illustrated in FIG. 11. While not required, a spring mechanism or the like can be provided to bias the filament lengths towards, in the illustrated example, the bottom of the cartridge at which is located the opening from which the filament lengths are to be drawn. It is desirable that such cartridges 18 be refillable. It will also be appreciated that such filament lengths could be provided on a spool 16.

In a further embodiment, the filament lengths are pre-cut (which may include leaders) and are intended to be removed from the cartridge 18 one at a time.

For moving the filament lengths from the cartridge 18 to the shuttle assembly 20, e.g., the first filament length in the case of loosely coupled filament lengths or each filament length in the case of pre-cut filament lengths, a feeding assembly 50 is provided. In the illustrated example, the feeding assembly 50 comprises a driven element 52 which is adapted to grasp an end of an exposed filament length, i.e., accessible through the opening 54 in the cartridge 18, whereupon the driven element 52 is driven to carry the grasped filament length to the shuttle assembly 20 for collection thereby. For this purpose, the driven element 52 may be carried on a rack and pinion assembly as illustrated. It will be understood, however, that other mechanisms can be used to move the driven element 52 from the cartridge 18 to the shuttle assembly 20 without limitation.

It will additionally be appreciated that, should the filament 12 have pre-cut or loosely coupled lengths, a trimming mechanism may not be required.

Figure 17:
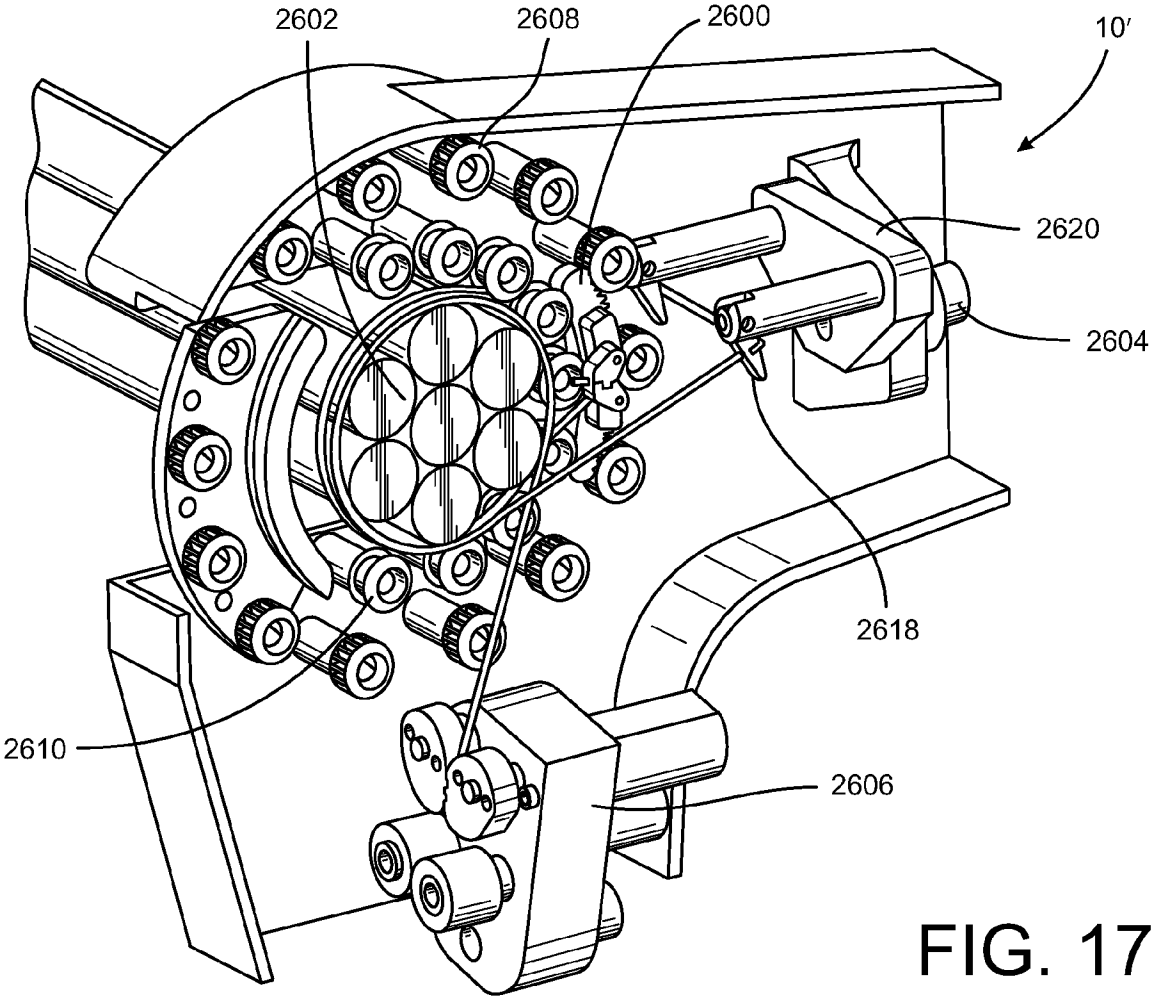
FIG. 17 illustrates a further exemplary knot tying device constructed according to the description that follows.

Turning to FIG. 17, a further exemplary knot tying device is illustrated. Generally, the device 10' illustrated in FIG. 17 includes a filament carrying shuttle 2600 which is caused to be moved in a circular path around a wire bundle 2602 and at least one device 2604 (of which two are illustrated) for releasably pulling the filament away from the wire bundle 2602 at appropriate times during the knot tying process and for rotating the filament to form loops through which the shuttle 2600 is passed during the knot typing process. During the knot tying process, the shuttle 2600 will move in the circular path in a single plane that is generally transverse to the wire bundle. Filament is fed to the shuttle 2600 by a filament supply device 2606.

Figure 19:
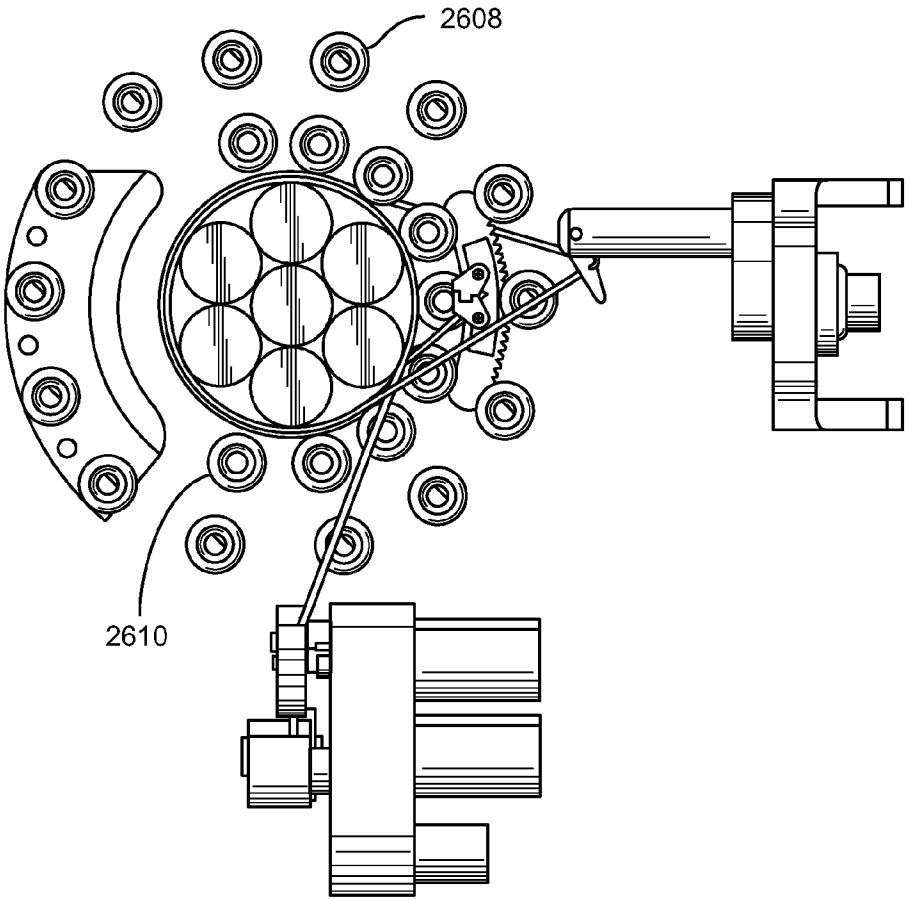
FIGS. 18-20 illustrate an exemplary device for driving a shuttle about a wire bundle and for arranging filament relative to the wire bundle for tying knots.
Figure 18:
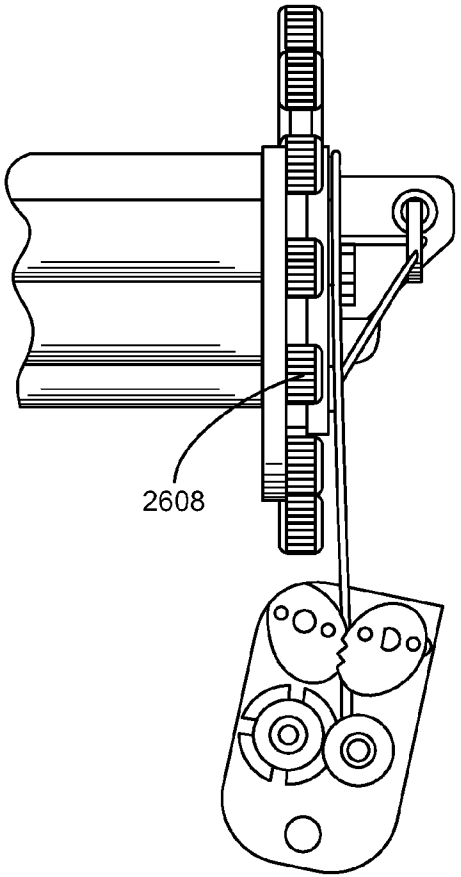

For moving the shuttle 2600 in either direction along the circular path, the shuttle 2600 is provided with a toothed outer surface which is adapted to be driven by correspondingly toothed drive gears 2608 as further illustrated in FIGS. 18 and 19. As the shuttle 2600 is caused to be moved by the drive gears 2608, the shuttle is further supported by rollers 2610. As will be appreciated, the number of drive gears 2608 and rollers 2610 can be varied as needed depending upon, for example, the size of the shuttle 2600.

Figure 20:
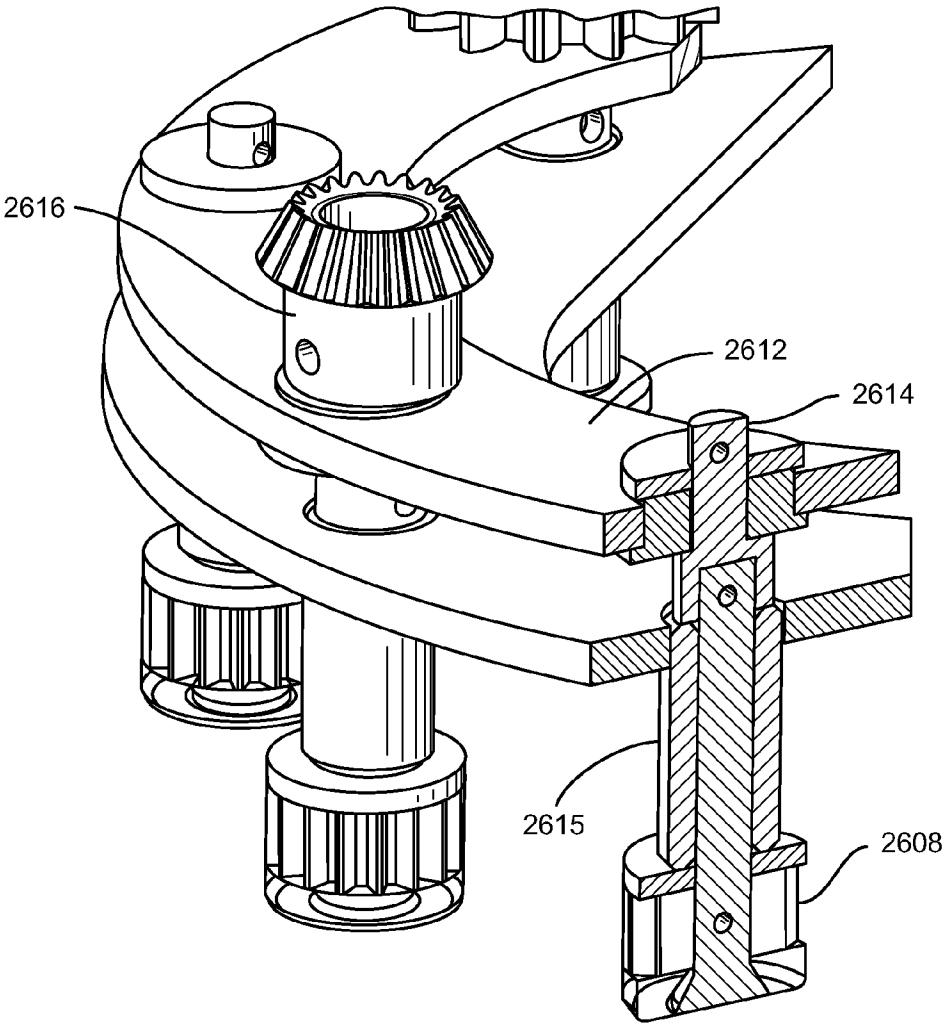
Figure 21C:
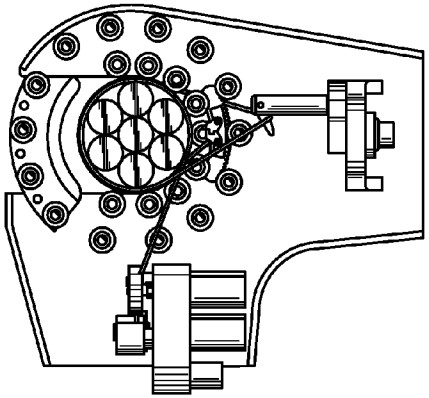
FIGS. 21A-21D illustrate the exemplary device of FIG. 17 being used to tie a knot.
Figure 21B:
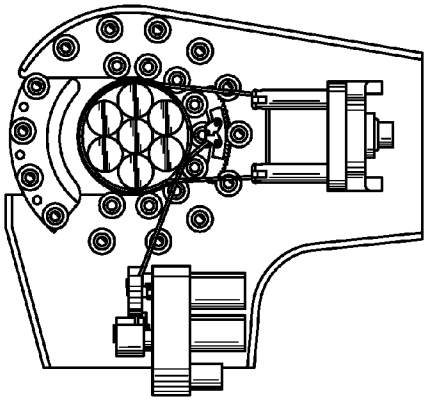
Figure 21A:
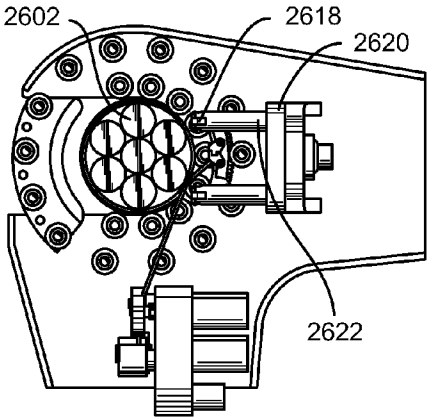

To drive the drive gears 2608, and thereby cause the shuttle 2600 to be moved about the circular path, the drive gears 2608 may be mounted to a wobble plate 2612 as illustrated in FIG. 20. The wobble plate 2612 is caused to be wobbled by a driven gear 2616 and, the wobbling motion of the wobble plate 2612, is transferred to the drive gears 2608 via an eccentric pin 2614 and an output shaft 2615. More particularly, as the wobble plate 2612 wobbles, the eccentric pin 2614 is caused to rotate and the output shaft 2615, coupled thereto, likewise rotates to drive a drive gear 2608 coupled thereto. The driven gear 2616 may be driven by a chain, belt, gears, or the like which would be coupled to a motor. Alternatively, the drive gears 2608 may be caused to rotate by being coupled directly to a motor without the use of the described wobble plate mechanism, such as by being driven by a chain, belt, gears, or the like.

Figure 22A:
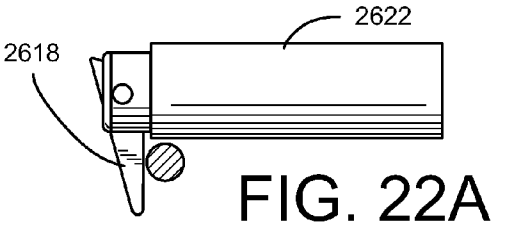
FIGS. 22A and 22B illustrate exemplary hooks used to pull the filament during a knot tying process in a latched and unlatched state, respectively.
Figure 22B:
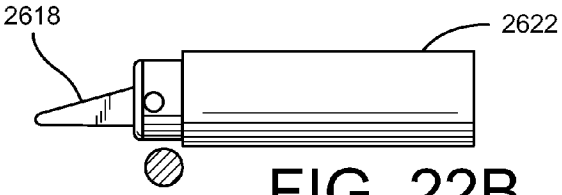
Figure 21D:
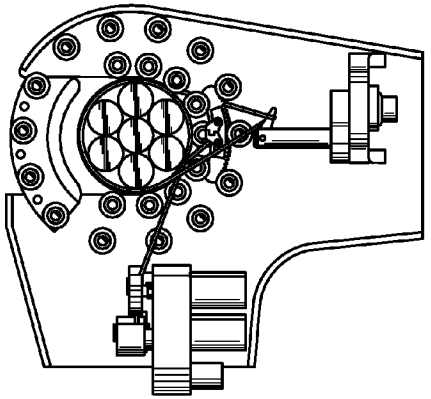

For tying a knot around the wire bundle 2602, the shuttle 2600 is caused to be moved over a hook 2618 or hooks of the device 2604 whereupon the device 2604 (and hook 2618) is caused to be retracted, i.e., moved away from the wire bundle 2602, to thereby form a loop as illustrated in FIG. 21. To this end, the device 2604 is mounted to a support 2620 which is adapted to move laterally with respect to the wire bundle 2602 and to rotate. As further illustrated in FIGS. 21A-21D, the support 2620 is particularly rotated to thereby orient the loop at an angle with respect to the circular path traveled by the shuttle 2600 to thereby allow the shuttle 2600 to pass through the loop and, accordingly, under the filament as held by the hook 2618. The support 2620 can be rotated both clockwise and counter-clockwise to created loops through which the shuttle 2600 can pass by being moved in the clockwise and counter-clockwise direction, respectively. Once the shuttle 2600 has been moved through a loop, the hook 2618 can be moved to release the filament whereupon the filament may be tightened against the wire bundle 2602, for example via further movement of the shuttle 2600. To provide the hook 2618 with movement, the hook 2618 is pivotally mounted to a housing 2622, which is carried by the support 2620, within which is a positioned a reciprocating device used to pull or push the hook 2618 with respect to the housing 2622 to thereby move the hook 2618 between a filament latching position and a filament releasing position as shown in FIGS. 22A and 22B, respectively.

Figure 23B:
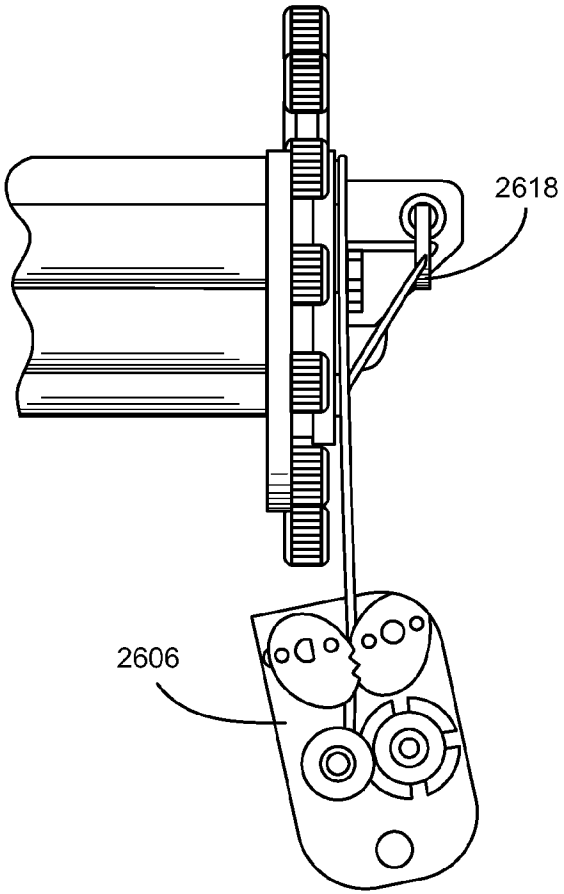
FIGS. 23A and 23B illustrate an exemplary filament feed device being moved during a knot tying process.
Figure 23A:
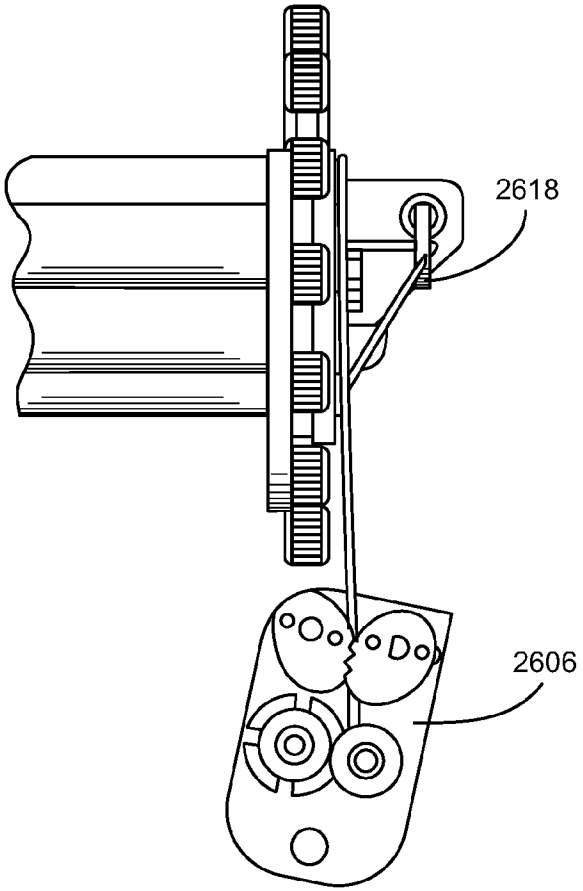
Figure 24:
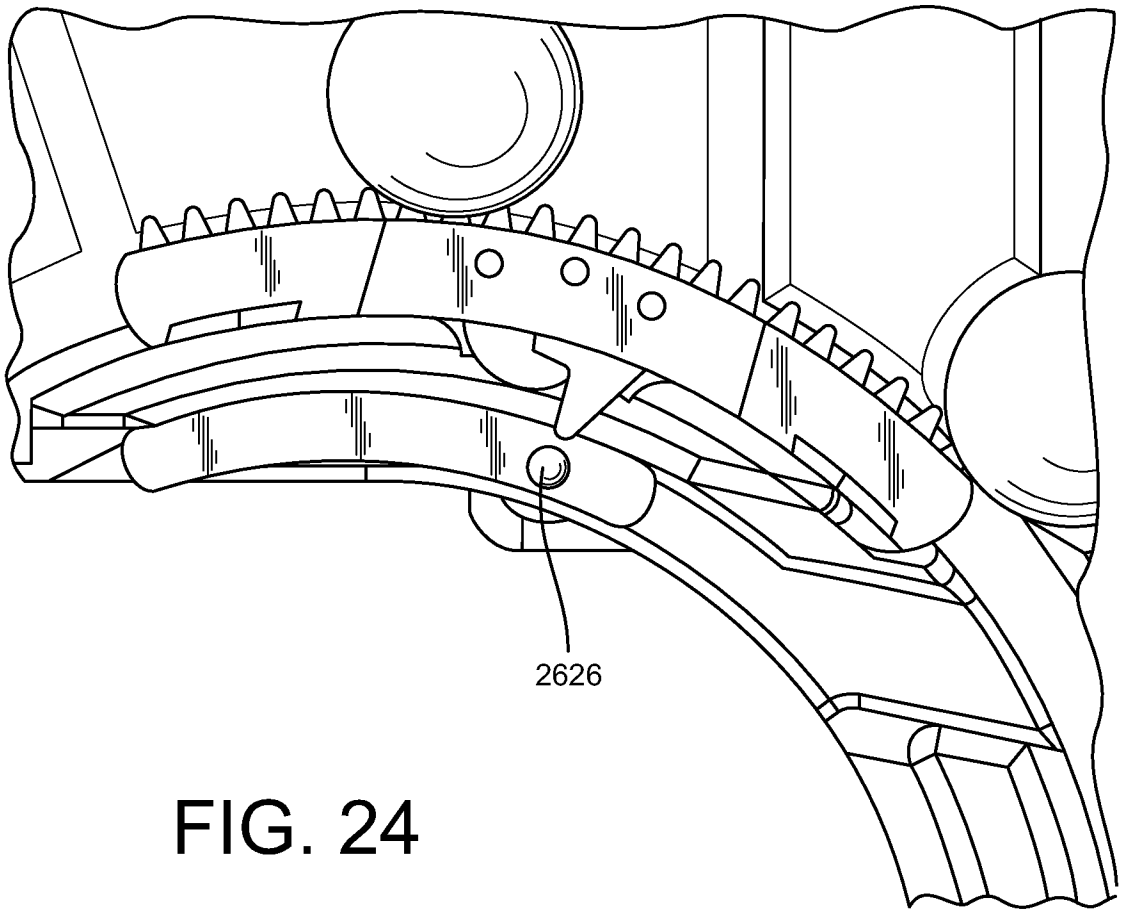
FIG. 24 illustrates an exemplary device for holding a knot during a knot tying process.

For further controlling the position of the filament during the knot tying process, the system 2606 which is used to feed the filament to the shuttle 2600 is also rotatable in a plane that is generally transverse to the circular path of travel of the shuttle 2600. More particularly, as illustrated in FIGS. 23A and 23B, the system 2606 can be rotated in a first direction, e.g., towards the right as shown in FIG. 23A, to thereby cause the filament to be applied to a right side of the area in which the knot is being formed and the system 2606 can be rotated in a second direction, e.g., towards the left as shown in FIG. 23B, to thereby cause the filament to be applied to the left side of the area in which the knot is being formed. In addition, as illustrated in FIG. 24, a positioning pin 2626 may be provided for engaging with a knot being formed when the filament is being tightened to thereby prevent the knot from being moved from the knot tying location as, for example, the shuttle 2600 is being moved to tighten the filament about the wire bundle 2602. Preferably, the positioning pin 2626 is arranged on a moveable device such that the pin 2626 can be retracted or otherwise moved out of engagement with the filament during such times as the device is being used to form the knot or otherwise wrap the wire bundle 2602. The positioning pin 2626 is additionally preferably arranged to provide a force upon the knot in a direction that is generally tangential to the wire bundle 2602 at the point of the knot.

Figure 25B:
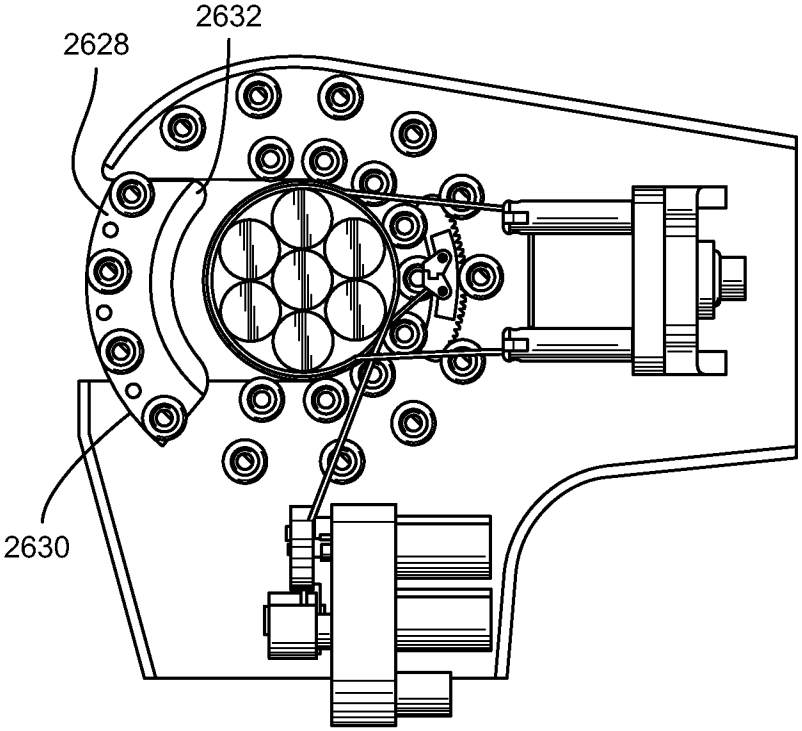
FIGS. 25A and 25B illustrate an exemplary gate being used to cover a bundle accepting opening of the device of FIG. 17.
Figure 25A:
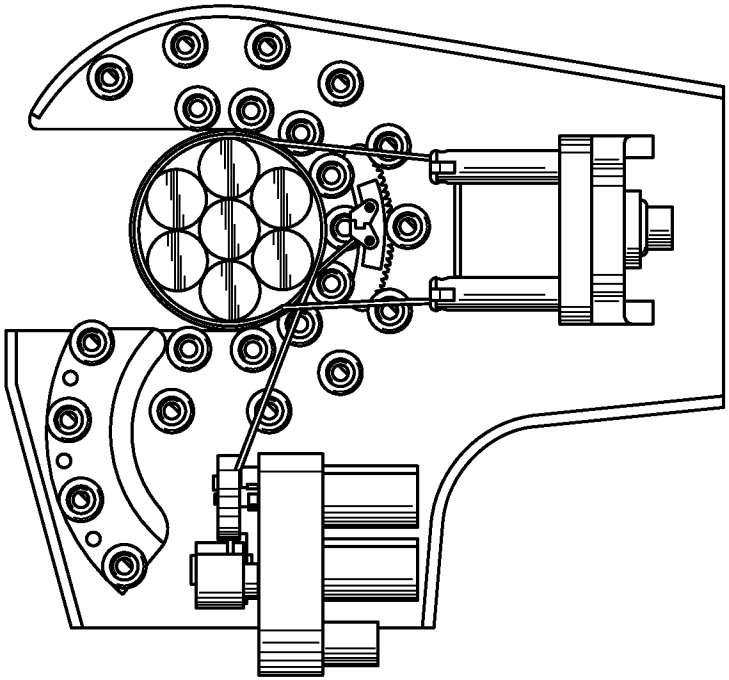
Figure 26:
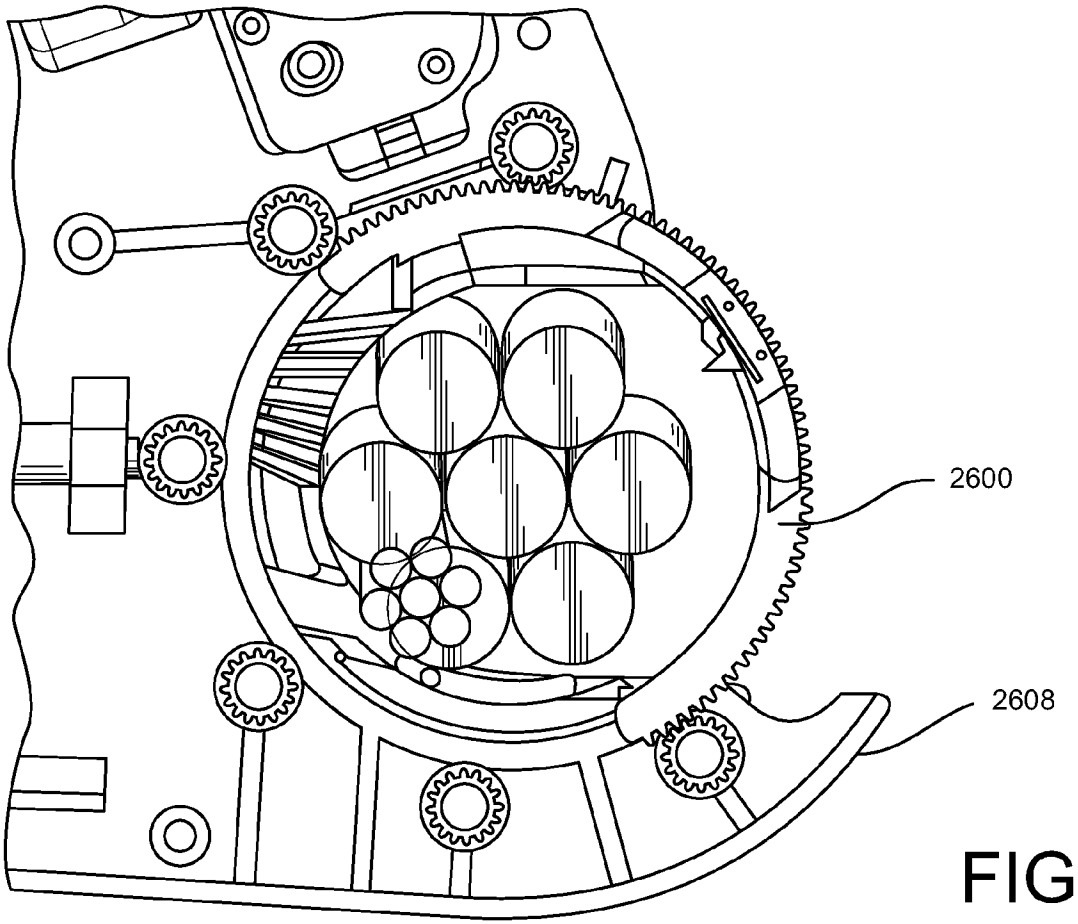
FIG. 26 illustrates an embodiment of the device of FIG. 17 wherein a filament carrying shuttle is sized to traverse the bundle accepting opening during a knot tying process.

To insert and remove the wire bundle 2602 from the device 10', the device 10' is provided with an opening. To facilitate the movement of the shuttle 2600 in the circular path during the knot tying process, the opening is preferably closed (wholly or partially) by a moveable gate 2628 as illustrated in FIGS. 25A and 25B. The moveable gate 2628 may therefore include further drive gears 2630 and a support structure 2632 (which may be rollers, a surface, or the like) for moving and supporting the shuttle 2600 through the moveable gate 2628. In a preferred embodiment, the moveable gate 2628 has an integrated drive train to drive the drive gears 2630 which drive train may be coupled to the same devices that function to drive the driven gears 2616. As will be appreciated, a further drive mechanism would be provided to move the moveable gate 2628 into and out of position relative to the opening of the device 10'. In a further embodiment, illustrated in FIG. 26, the moveable gate 2628 need not be provided as the shuttle 2600 is sized to span the gap created by the opening of the device 10'. Specifically, in such an embodiment the shuttle 2600 would have a length that ensures that, when the shuttle 2600 spans the gap created by the opening of the device 10', the shuttle 2600 will be engaged with at least one of the drive gears 2608.

Figure 27B:
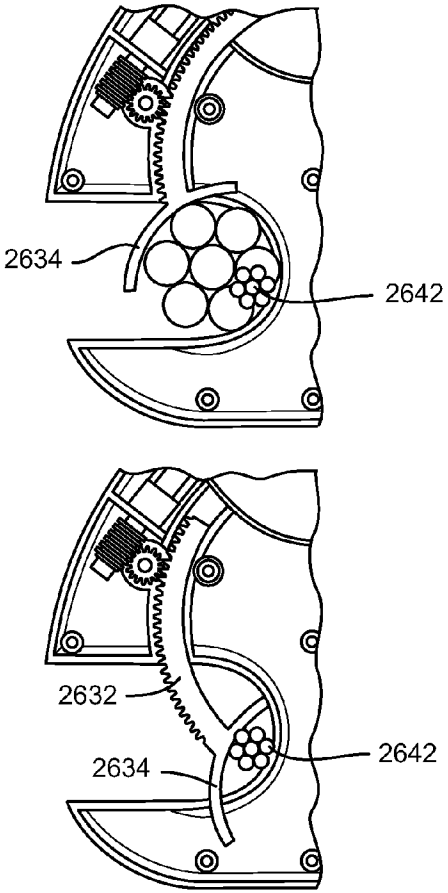
FIGS. 27A and 27B illustrates an exemplary device for securing and positioning a wire bundle in the device of FIG. 17.
Figure 27A:
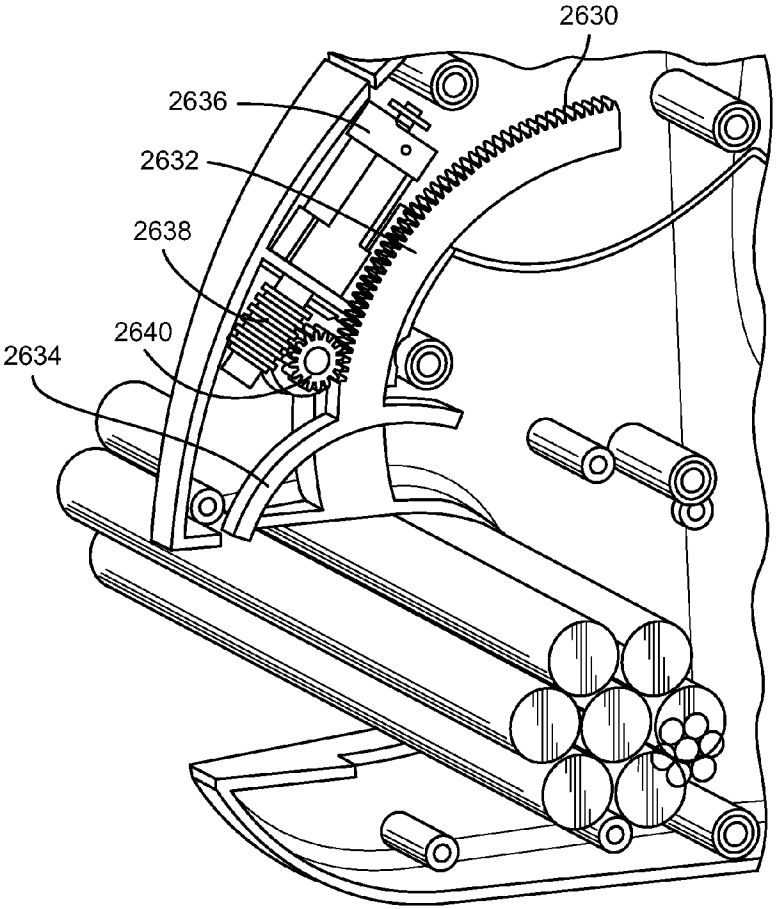

To maintain a wire bundle 2602 in proper position when inserted into the device 10', the device 10' may additionally include a bundle securing device 2630. The bundle securing device 2630 includes a retractable arm 2632 having disposed on one end thereof a bundle engaging portion 2634. The retractable arm 2632 may be driven, for example via use of a motor 2636 having an output shaft which carries a worm gear 2638 which, in turn, drives a toothed gear 2640 which engages with corresponding teeth formed on the retractable arm 2632. The retractable arm 2632, and accordingly the bundle engaging portion 2634, may thus be driven into, or retracted from, a wire bundle 2620 via appropriate clockwise and counter-clockwise rotation of the worm gear 2638 coupled to the output shaft of the motor 2636. For retractable arm 2632 is preferably arcuately shaped, and thereby driven in an arc as shown in FIGS. 27A and 27B, to thereby allow the arcuately shaped, bundle engaging portion 2634 to secure and properly orient wire bundles 2620 of various sizes against a back wall 2642 of the housing, which is also arcuately shaped, in the vicinity of the device 2604, i.e., a location in the vicinity of where the knot is to be formed. Because the device 10' may accept wire bundles 2602 of various sizes, the device 10' may be equipped with a further device that functions to stop rotation of the 2636 (or to allow slippage of the arm 2632 against the driving force of the motor 2636) when the retractable arm 2632 securely presses a wire bundle 2602 against the back wall 2642.

Figure 28:
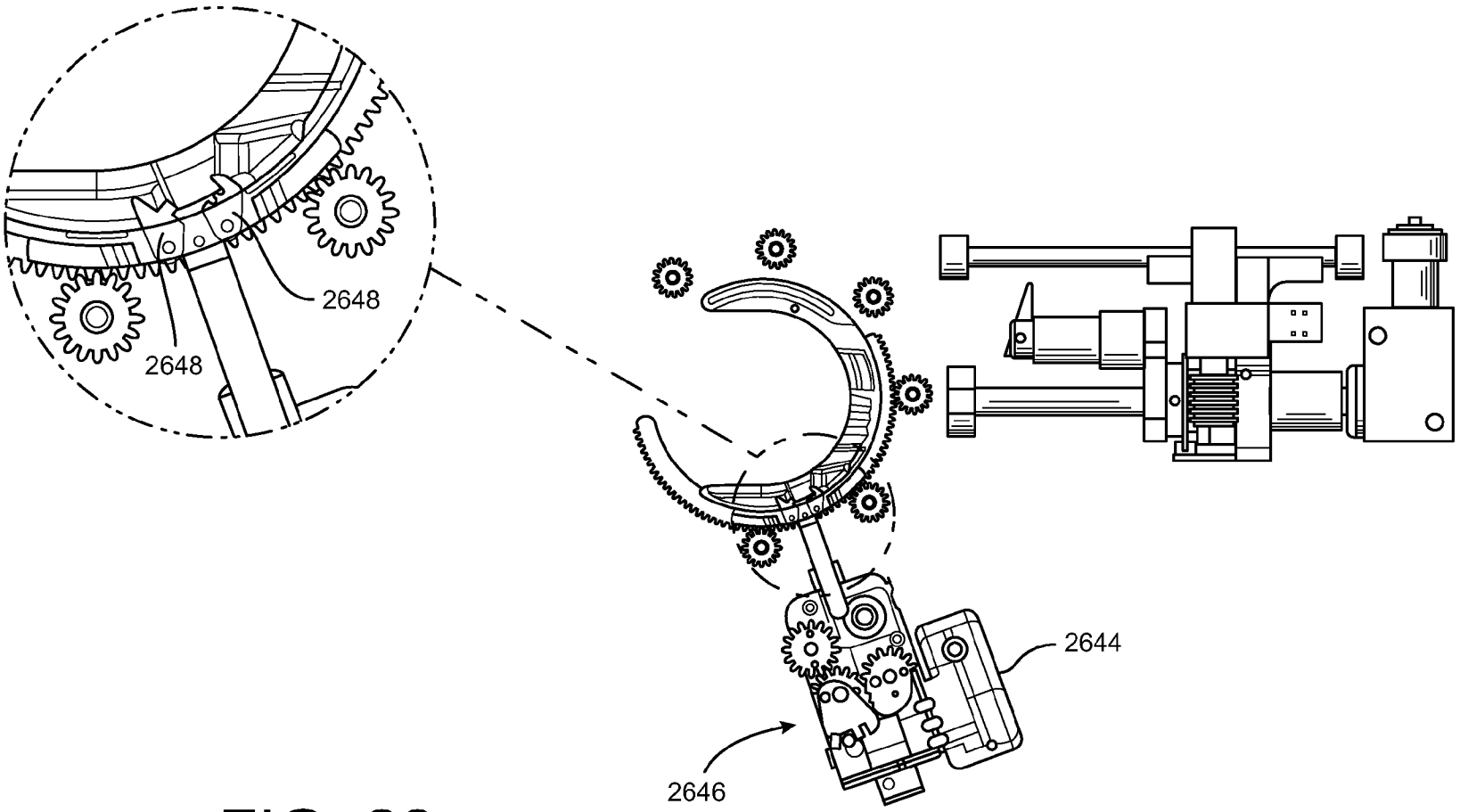
FIG. 28 illustrates an exemplary device for feeding filament to the shuttle of the device of FIG. 17.

For more accurately feeding the filament to the shuttle 2600, the feeding device 2606 is arranged to be retractable into and away from the shuttle 2600. To this end, as illustrated in FIG. 28, the feeding device 2606 may be provided with a motor 2644 and associated drive mechanism 2646 for drive the feeding device 2606 towards and away from the shuttle 2600. In addition, to more accurately feed the filament to the shuttle 2600, upon arriving at the shuttle 2600 the forward end of the feeding device 2606 will function to separate biased gripping elements 2648 of the shuttle device 2600 to position the filament between the gripping elements 2648 whereby, upon the feeding device 2606 being retracted, the gripping elements 2648 will close upon the fed filament and grasp the filament for movement via movement of the shuttle 2600. The gripping elements 2648 may be pivotally mounted to the shuttle 2600 and may be biased to close upon each other via use of spring or the like.

As will be appreciated, movement of the various moveable elements of the device 10' may be controlled via a controller having associated instructions and, by the controller, the elements of the device 10' may be moved in various different manners to cause the device 10' to tie various different types of knots around wire bundles 2602.

Figure 29:
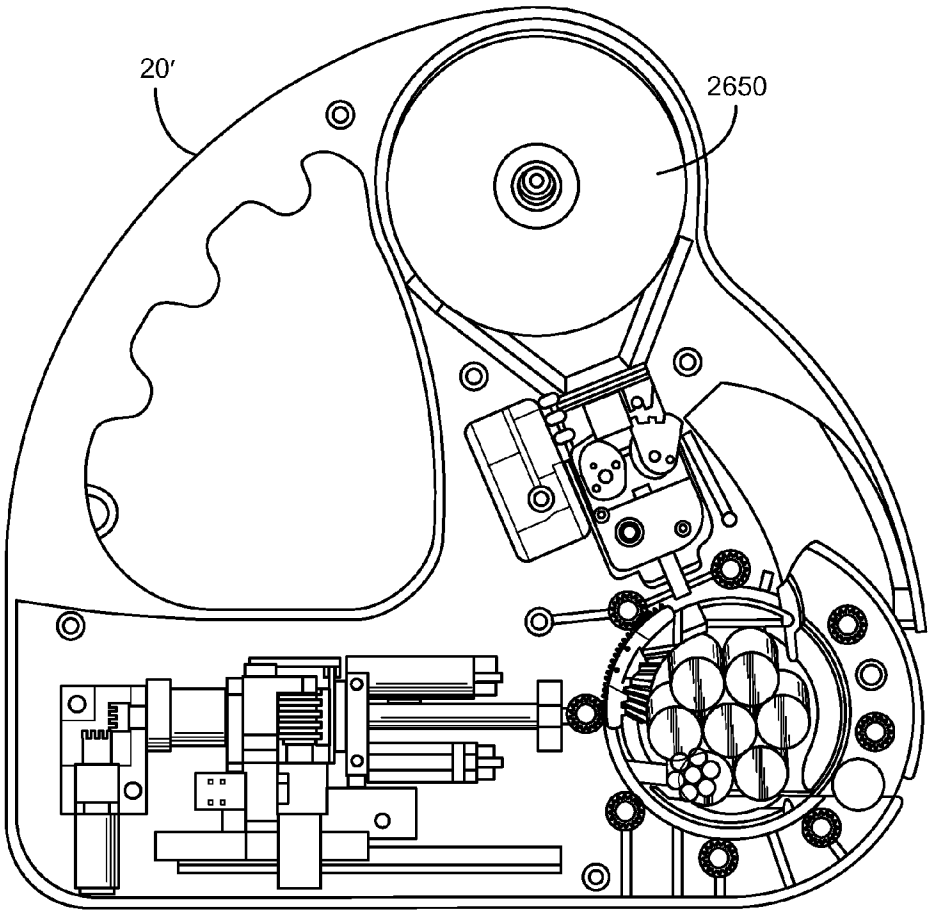
FIG. 29 illustrates the device of FIG. 17 using a filament cartridge.
Figure 30:
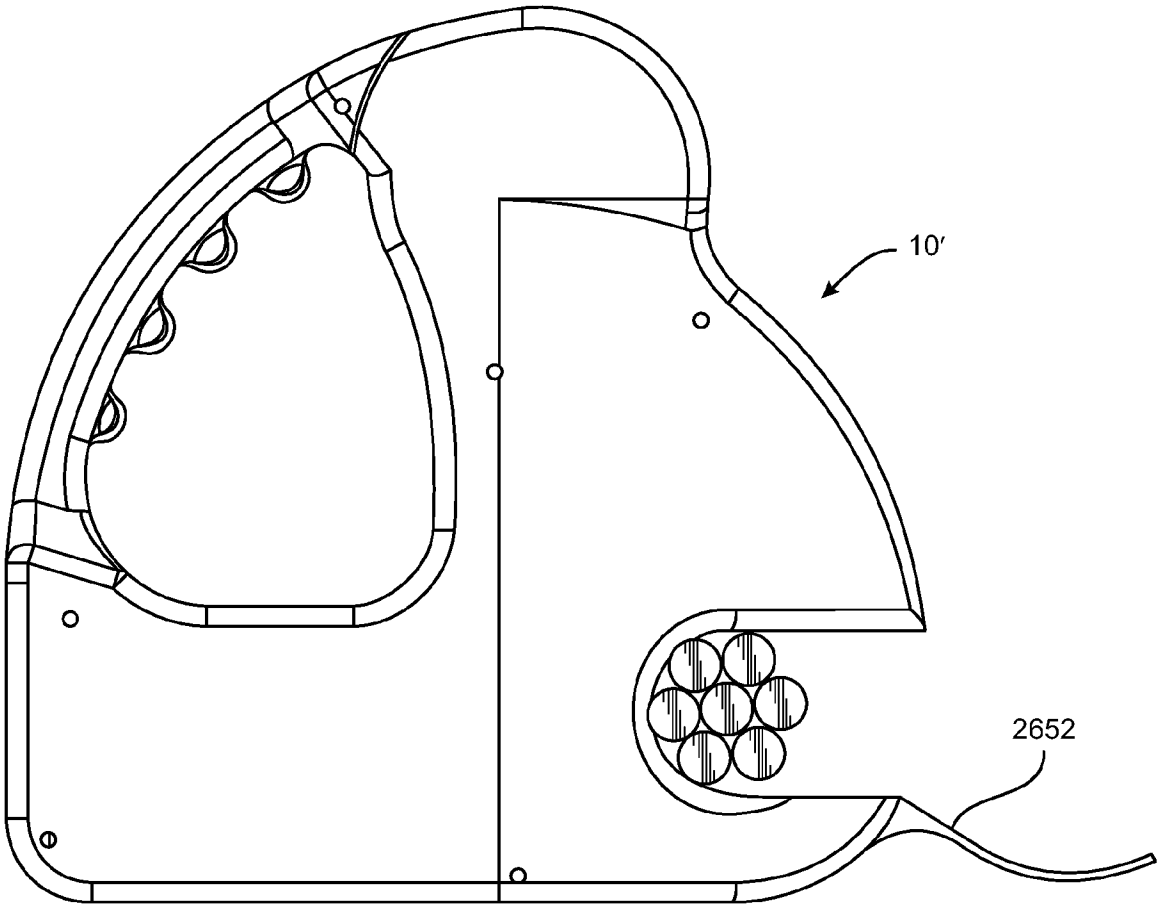
FIG. 30 illustrates an exemplary arm used to facilitate placement of a wire bundle into the device of FIG. 17.

As described previously, the device may also carrying a disposable spool or cartridge 2650 which carries a length of filament for tying knots around one or more wire bundles 2602. Such an exemplary device 20' is shown in FIG. 29. In addition, the device 10', which may be handheld, may include a shoe horn type arm 2652 for use in guiding a wire bundle 2602 into the opening of the device 10' as illustrated in FIG. 30.

While specific embodiments of the subject invention have been described in detail, it will be appreciated by those skilled in the art that various modifications and alternatives to those details could be developed in light of the overall teachings of this disclosure. For example, it is to be appreciated that the programming can allow for the control of the elements to thereby tie one of multiple different types of knots, which type of knot to be tied may be user selectable. Accordingly, the particular arrangements disclosed are meant to be illustrative only and not limiting as to the scope of the invention which is to be given the full breadth of the appended claims and any equivalents thereof.

What is claimed is:

1. A device for tying a filament in a knot around an article, comprising:

a housing; and a knot-tying mechanism disposed within the housing, the knot-tying mechanism being comprised of:

a pair of rings surrounding the article each having a continuous channel formed therein wherein the channels of each of the pair of rings oppose one another;

a shuttle adapted to releasably grasp the filament, wherein the shuttle is caused to be moved during a knot tying process between and within the channels of each of the pair of rings and thereby around and along a length of the article; and at least one device for pulling the filament away from the article at appropriate times during the knot tying process.

2. The device as recited in claim 1, comprising a plurality of electromagnets associated with each of the pair of rings wherein the plurality of electromagnets are selectively activated to cause the shuttle to be moved between and with the channels of each of the pair of rings.

3. The device as recited in claim 2, wherein the plurality of electromagnets are integrated into respective channels within each of the pair of rings.

4. The device as recited in claim 2, wherein the plurality of electromagnets are positioned adjacent to respective channels at an exterior, backside surface of each of the pair of rings.

5. The device as recited in claim 2, comprising a processor and associated programming for selectively activating the electromagnets and the device for pulling the filament away from the article to thereby cause a desired knot to be tied about the article.

6. The device as recited in claim 5, wherein the programming provides for the tying of multiple different types of knots.

7. The device as recited in claim 6, wherein the type of knot to be tied is user selectable.

8. The device as recited in claim 1, wherein a first half and a second half of the pair of rings are separable to provide for the article to be positioned with the pair of rings.

9. The device as recited in claim 8, wherein the first half of the pair of rings is pivotally attached to the housing and a driving mechanism is provided to move the first half of the pair of rings relative to the second half of the pair of rings.

10. The device as recited in claim 1, comprising a tensioning mechanism for providing tension to the filament during the knot tying process.

11. The device as recited in claim 10, wherein the tensioning mechanism comprises a moveable arm and a hook used to hook and thereafter release the filament during the knot tying process.

12. The device as recited in claim 1, comprising a mechanism for feeding filament from a filament delivery device to the shuttle assembly.

13. The device as recited in claim 12, wherein the filament delivery device comprises a cartridge that is removeably mountable to the housing.

14. The device as recited in claim 13, wherein the cartridge comprises a plurality of loosely coupled, predetermined lengths of filament.

15. The device as recited in claim 13, wherein the cartridge comprises a plurality of pre-cut, predetermined lengths of filament.

16. The device as recited in claim 1, wherein the article comprises a bundle of wires.

17. The device as recited in claim 16, comprising a clamping mechanism for clamping and/or positioning the bundle of wires within the pair of rings.

18. The device as recited in claim 1, comprising at least one electromagnet carried on a device which is rotatably driven behind each of the pair of rings wherein the at least one electromagnet is selectively activated to cause the shuttle to be moved between and with the channels of each of the pair of rings.

19. The device as recited in claim 18, wherein the at least one electromagnet is carried on a rotatably driven gear.

20. The device as recited in claim 19, wherein the rotatably driven gear carries at least one counterweight to balance the rotatably driven gear when driven to rotate.

21. A method for tying a filament in a knot around an article, comprising:

using a shuttle which grasps the filament to move the filament about the article in a circular path on a single knot forming plane; and using a device to pull the filament away from the article at appropriate times during movement of the filament about the article and to rotate the filament to thereby form loops through which the shuttle carrying the filament is passed.

22. A device for tying a filament in a knot around an article, comprising:

a housing; and a knot-tying mechanism disposed within the housing, the knot-tying mechanism being comprised of:

a shuttle adapted to releasably grasp the filament, wherein the shuttle moves in a circular path on a single knot forming plane;

a device for pulling the filament away from the article at appropriate times during movement of the filament about the article and for rotating the filament to thereby form loops through which the shuttle carrying the filament is passed.

23. The device as recited in claim 22, comprising a device for feeding the filament to the shuttle wherein the feeding mechanism rocks to dictate to which side of the knot forming plane the filament is supplied to the shuttle.

24. The device as recited in claim 22, comprising a device for feeding the filament to the shuttle, wherein the shuttle has a pair of moveable gripping elements, and wherein the feeding element moves the filament between the gripping elements and then retracts to allow the gripping elements to close upon and grip the filament.

25. The device as recited in claim 22, wherein the housing comprises a counter balance.

26. The device as recited in claim 22, comprising driven drive gears for moving the shuttle in the circular path.

27. The device as recited in claim 26, comprising a wobble plate and eccentric pin drive to train for driving the drive gears.

28. The device as recited in claim 26, wherein the drive gears are coupled to a motor by one or more of gears and a belt.

29. The device as recited in claim 22, comprising programming for controlling operation of the shuttle and the device for pulling the filament.

30. The device as recited in claim 29, wherein the programming is adapted to provide for tying of multiple different types of knots.

31. The device as recited in claim 30, wherein a type of knot to be tied is user selectable.

32. The device as recited in claim 22, wherein the housing has an opening arranged to accept the article and the device comprises a gate arranged to enclose the opening.

33. The device as recited in claim 32, wherein the gate forms a part of the circular path.

34. The device as recited in claim 22, wherein the housing has an opening arranged to accept the article and the shuttle is sized to span the opening.

35. The device as recited in claim 22, comprising a tensioning mechanism for providing tension to the filament during the knot tying process.

36. The device as recited in claim 35, wherein the tensioning mechanism comprises the shuttle being moved.

37. The device as recited in claim 35, wherein the tensioning mechanism is user adjustable.

38. The device as recited in claim 31, wherein the device for pulling the filament away from the article at appropriate times during a knot tying process and for rotating the filament comprises a hook moveable to a first position to engage the filament and a second position to release the filament.

39. The device as recited in claim 22, wherein the filament is carried on a cartridge that is removeably mountable to the housing.

40. The device as recited in claim 39, wherein the cartridge comprises a plurality of loosely coupled, predetermined lengths of filament.

41. The device as recited in claim 33, wherein the cartridge comprises a plurality of pre-cut, predetermined lengths of filament.

42. The device as recited in claim 22, wherein the article comprises a wire bundle.

43. The device as recited in claim 22, comprising a device for clamping and/or positioning the article within the circular path.

44. The device as recited in claim 43, wherein the device for clamping and positioning is adapted to clamp and/or position bundles of wires having multiple different diameters.

45. The device as recited in claim 22, comprising a device for holding a knot being formed against the article.

46. The device as recited in claim 45, wherein the device for holding a knot being formed comprises a retractable pin.

47. The device as recited in claim 22, wherein the housing has an opening arranged to accept the article and the device comprises a surface for guiding the article into the opening.

* * * * *